US010335846B2

(12) United States Patent
Matsuno et al.

(10) Patent No.: US 10,335,846 B2
(45) Date of Patent: Jul. 2, 2019

(54) MANUFACTURING METHOD AND MANUFACTURING DEVICE OF SHEARED COMPONENTS

(71) Applicant: NIPPON STEEL & SUMITOMO METAL CORPORATION, Tokyo (JP)

(72) Inventors: Takashi Matsuno, Tottori (JP); Koichi Sato, Tokai (JP); Takashi Yasutomi, Chiba (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 176 days.

(21) Appl. No.: 15/309,142

(22) PCT Filed: May 7, 2015

(86) PCT No.: PCT/JP2015/063215
§ 371 (c)(1),
(2) Date: Nov. 4, 2016

(87) PCT Pub. No.: WO2015/170707
PCT Pub. Date: Nov. 12, 2015

(65) Prior Publication Data

US 2017/0080475 A1 Mar. 23, 2017

(30) Foreign Application Priority Data

May 8, 2014 (JP) ..... 2014-097044

(51) Int. Cl.
*B21D 28/02* (2006.01)
*B21D 28/14* (2006.01)
*B21D 28/16* (2006.01)

(52) U.S. Cl.
CPC ..... *B21D 28/02* (2013.01); *B21D 28/14* (2013.01); *B21D 28/16* (2013.01)

(58) Field of Classification Search
CPC ..... B21D 28/02; B21D 28/14; B21D 28/16
See application file for complete search history.

(56) References Cited

U.S. PATENT DOCUMENTS

2011/0314991 A1 12/2011 Yamamoto et al.

FOREIGN PATENT DOCUMENTS

CN 101018627 A 8/2007
CN 202667384 U 1/2013
(Continued)

OTHER PUBLICATIONS

International Search Report (Form PCT/ISA/210) for International Application No. PCT/JP2015/063215, dated Aug. 4, 2015, with an English translation thereof.
(Continued)

*Primary Examiner* — Teresa M Ekiert
(74) *Attorney, Agent, or Firm* — Birch, Stewart, Kolasch & Birch, LLP

(57) ABSTRACT

In a manufacturing method of sheared components, the shearing including a process of fixing a workpiece to a die, and a process of punching the workpiece by bringing a punch and the die relatively close to each other, is performed a plurality of times, and when a shearing sequence is started, the shearing is performed by using a punch including a first cutting edge having a first tip end surface which opposes the workpiece, and a first retracting surface which retracts from the first tip end surface considering an approaching direction to the die as a standard; and a die including a second cutting edge having a second tip end surface which opposes the workpiece, and a second retracting surface which retracts from the second tip end surface considering an approaching direction to the punch as a standard.

11 Claims, 16 Drawing Sheets

(56) References Cited

FOREIGN PATENT DOCUMENTS

| | | | |
|---|---|---|---|
| JP | 2002-275508 | A | 9/2002 |
| JP | 2002-321021 | A | 11/2002 |
| JP | 2007-307616 | A | 11/2007 |
| JP | 2012-11393 | A | 1/2012 |

OTHER PUBLICATIONS

Shionome et al., "Smooth Piercing of Ultrahigh-Strength Steel Sheets," Proceedings of the 2013 Japanese Spring Conference for the Technology of Plasticity, Japan Society for Technology of Plasticity, Jun. 7-9, 2013, with a partial English translation, pp. 193-194 (3 pages total).

Takaishi et al., "Extension of Blanking Die Life by Surface Coatings," Die and Mold Technology, vol. 18, No. 8, Jul. 2003, with a partial English translation, pp. 8-9 (3 pages total).

Chinese Office Action and Search Report for Chinese Application No. 201580023202.0, dated Dec. 14, 2017, with English translations.

MANUFACTURING METHOD AND MANUFACTURING DEVICE OF SHEARED COMPONENTS

TECHNICAL FIELD OF THE INVENTION

The present invention relates to a manufacturing method and a manufacturing device of sheared components, and specifically, to a manufacturing method and a manufacturing device of sheared components which are used in a vehicle, a construction machine, and various plants, and are made of high-tension steel or ultra-high-tension steel.

Priority is claimed on Japanese Patent Application No. 2014-097044, filed on May 8, 2014, the content of which is incorporated herein by reference.

RELATED ART

FIG. 16A is a sectional view schematically showing drilling for forming a hole by shearing a workpiece 1. In addition, FIG. 16B is a sectional view schematically showing cutting for forming an open section by shearing the workpiece 1.

When manufacturing sheared components which are used in a vehicle, a construction machine, and further, various plants, as shown in FIGS. 16A and 16B, after loading the workpiece 1 on a die 3, the workpiece 1 is punched by pushing a punch 2 in the outlined arrow direction in the drawing, and the sheared components are manufactured by shearing, in many cases.

FIG. 17 is a sectional view showing a sheared surface 8 which is formed in the sheared workpiece 1.

As shown in FIG. 17, the sheared surface 8 of the workpiece 1 formed by shearing includes: a sag 4 which is formed as the workpiece 1 is pushed by the punch 2; a sheared surface 5 which is formed as the workpiece 1 is drawn into a clearance (hereinafter, in a case where "clearance" is written without any particular remarks in the specification, the clearance means a clearance between the punch and the die) between the punch 2 and the die 3, and is locally extended; a fracture surface 6 which is formed as the workpiece 1 is drawn into the clearance between the punch 2 and the die 3 is fractured; and a burr 7 which is generated on a rear surface of the workpiece 1.

Shearing has an advantage that processing can be performed at a low cost. However, in recent years there has been a trend for the hardness required for the workpiece 1 to increase, and it is difficult to simply employ the shearing method used so far. For example, in a case where a high-tension steel sheet of which a tensile strength exceeds 780 MPa is used as the workpiece 1, since the burr 7 which is extremely large is generated due to a deficiency of a cutting edge, it is necessary to frequently exchange a die, and deterioration of productivity cannot be avoided.

In addition, "deficiency of a cutting edge" mentioned here is a phenomenon different from "wear of a cutting edge". In other words, while the wear is a phenomenon in which roundness of the cutting edge increases as the number of processings increases, the deficiency is a phenomenon in which the cutting edge becomes chipped due to the presence of cracks.

There are many cases where the wear of a tool cutting edge is suppressed by performing coating treatment on a surface of a tool, for example, as disclosed in Non-Patent Document 1.

In addition, with respect to the deficiency of the tool cutting edge, a method of absorbing and mitigating shock when the tool cutting edge is in a contact state using a flexible part as a fastening portion of the tool, or method for rounding or chamfering only the cutting edge of the punch, for example, as disclosed in Non-Patent Document 2, is known.

PRIOR ART DOCUMENTS

Patent Document

[Non-Patent Document 1] Die and Mold Technology, Vol. 18, No. 8, pp. 8-9

[Non-Patent Document 2] Proceedings of the 2013 Japanese Spring Conference for the Technology of Plasticity, Japan Society for Technology of Plasticity, pp. 193-194

DISCLOSURE OF THE INVENTION

Problems to be Solved by the Invention

A method of performing the coating treatment on the tool surface as described in the above-described Non-Patent Document 1 improves tool service life by reducing the frictional resistance between the tool surface and the workpiece. However, in the method, in a case of shearing a high-tension steel sheet of which the maximum tensile strength is equal to or greater than 780 MPa, it is not possible to prevent a sudden deficiency of the tool cutting edge which is caused by an impact on the tool cutting edge.

In addition, in the method for rounding the cutting edge only in the punch described in the above Non-Patent Document 2, it is not possible to prevent the deficiency of the cutting edge of the die. In addition, when shearing mild steel, in order to prevent generation of the burr in the workpiece, it is necessary to make the cutting edge of both of the punch and the die an acute angle, and even when rounding or chamfering the cutting edge as described in the above-described Non-Patent Document 2, a function as a shearing tool is not sufficiently achieved when not being limited to any one of the punch and the die.

Meanwhile, the inventors empirically understood that the frequency of generation of tool damage increases in a case where the ratio between the hardness of the workpiece and the hardness of the tool (die or punch) exceeds a certain value. The result of investigation of the ratio through experiment by the inventors is shown in the following Table 1. In addition, in the tool evaluation of Table 1, G indicates GOOD (excellent), and NG indicates NOT GOOD (there is a problem).

According to the experiment results, it was ascertained that the frequency of generation of tool damage rapidly increases in high-tension steel or ultra-high-tension steel in which the Vicker's hardness of the workpiece becomes equal to or greater than 0.3 times the Vicker's hardness of the tool. In addition, in the experiment of Table 1, an experiment in which the punch and the die which respectively had the tool cutting edge having an acute angle were used, was performed. In addition, the clearance between the punch and the die in a case where the sheet thickness of the workpiece was t, varied within a range of 0.1×t to 0.2×t, but this did not influence the results, and it was confirmed that the ratio between the hardness of the workpiece and the hardness of the tool is dominant.

[Table 1]

From the above, it was confirmed that a mechanism of the tool damage changed greatly considering 0.3 times the ratio between the hardness of the workpiece and the hardness of the tool as a boundary. This was not disclosed or suggested in either of the above-described Non-Patent Document 1 or Non-Patent Document 2.

Accordingly, in the related art, means for shearing a high-strength workpiece which is made of high-tension steel or ultra-high-tension steel without a deficiency of a tool cutting edge was not established. Therefore, as described above, in order to prevent the generation of the burr 7 which is extremely large due to the deficiency of the tool cutting edge, it is necessary to frequently exchange the die.

Considering the above-described situation, an object of the present invention is to provide a manufacturing method and a manufacturing device of sheared components which can manufacture the sheared components at a low cost without generation of a sudden deficiency of a cutting edge, even when a workpiece which is made of high-tension steel or ultra-high-tension steel in which the Vicker's hardness thereof becomes equal to or greater than 0.3 times the Vicker's hardness of a tool is used.

Means for Solving the Problem

In order to solve the above-described problem and achieve the related object, the present invention employs the following aspects.

(1) A manufacturing method of sheared components according to an aspect of the present invention is a method for manufacturing a plurality of sheared components by performing a shearing a plurality of times by using a punch and a die with respect to a workpiece of which a Vicker's hardness is equal to or greater than 0.3 times and less than 1.0 times the lower one of the Vicker's hardness of the punch and the Vicker's hardness of the die, in which the shearing including a process of fixing the workpiece to the die, and a process of punching the workpiece by bringing the punch and the die relatively close to each other, is performed a plurality of times, and in which, when a shearing sequence is started, the shearing is performed by using a punch including a first cutting edge having a first tip end surface which opposes the workpiece, and a first retracting surface which retracts from the first tip end surface considering an approaching direction to the die as a standard; and a die including a second cutting edge having a second tip end surface which opposes the workpiece, and a second retracting surface which retracts from the second tip end surface considering an approaching direction to the punch as a standard.

(2) In the aspect described in the above-described (1), the first retracting surface in a case of being viewed on a section perpendicular to the first tip end surface, may be a curved surface having a curvature that is equal to or greater than Rmin (mm) defined by a following Equation 1 and that is equal to or less than Rmax (mm) defined by a following Equation 2, or a chamfer having an inclination angle of 45° with respect to a tangent of the first tip end surface, and having a width dimension that is equal to or greater than αmin (mm) defined by a following Equation 3 and that is equal to or less than αmax (mm) defined by a following Equation 4, and the second retracting surface in a case of being viewed on a section perpendicular to the second tip end surface, may be a curved surface having a curvature that is equal to or greater than Rmin (mm) defined by the following Equation 1 and that is equal to or less than Rmax (mm) defined by the following Equation 2, or a chamfer having an inclination angle of 45° with respect to a tangent of the second tip end surface, and having a width dimension that is equal to or greater than αmin (mm) defined by the following Equation 3 and that is equal to or less than αmax (mm) defined by the following Equation 4.

$$R\min=(0.9+0.2e^{-0.08c})(0.3571x^2-0.2595x+0.0965) \quad \text{(Equation 1)}$$

$$R\max=(0.9+0.2e^{-0.08c})(-9.1856x^4+25.17x^3-24.95x^2+11.054x-1.5824) \quad \text{(Equation 2)}$$

$$\alpha\min=0.0222e^{2.0833x}(0.9+0.1e^{-0.07c}) \quad \text{(Equation 3)}$$

$$\alpha\max=(0.9+0.1e^{-0.0c})(-0.3274x^2+0.9768x-0.1457) \quad \text{(Equation 4)}$$

here, e is a base of a natural logarithms, c (mm) indicates a clearance between an inner surface of the die and an outer surface of the punch, and x of the punch is a hardness ratio obtained by dividing the Vicker's hardness of the workpiece by the Vicker's hardness of the punch, x of the die is a hardness ratio obtained by dividing the Vicker's hardness of the workpiece by the Vicker's hardness of the die in the die, and satisfies $0.3 \leq x < 1.0$.

(3) In a case of the above-described (2), one or both of the first retracting surface and the second retracting surface may be a curved surface having a curvature of 0.05 mm to 0.5 mm, or one or both of the first retracting surface and the second retracting surface may be a chamfer with a chamfer distance of C0.05 mm to C0.5 mm.

(4) In the aspect described in any one of the above-described (1) to (3), at least one of a first condition in which a frictional resistance of the first retracting surface is the highest among the first tip end surface, the first retracting surface, and the outer surface of the punch, or a second condition in which a frictional resistance of the second retracting surface is the highest among the second tip end surface, the second retracting surface, and the inner surface of the die, may be satisfied.

(5) In the aspect described in any one of the above-described (1) to (4), any one of a surface decarbonizing treatment, a plating, and a specific lubricating treatment may be performed with respect to the workpiece.

(6) A manufacturing device of sheared components according to another aspect of the present invention is a device for manufacturing a plurality of sheared components by performing a shearing a plurality of times with respect to a workpiece of which a Vicker's hardness is equal to or greater than 0.3 times and less than 1.0 times the lower one of the Vicker's hardness of a punch and the Vicker's hardness of a die, the device including: the die which fixes the workpiece; and the punch which punches the workpiece by bringing the workpiece relatively close to the die, in which the punch includes a first cutting edge having a first tip end surface which opposes the workpiece, and a first retracting surface which retracts from the first tip end surface considering an approaching direction to the die as a standard, and in which the die includes a second cutting edge having a second tip end surface which opposes the workpiece, and a second retracting surface which retracts from the second tip end surface considering an approaching direction to the punch as a standard.

(7) In the aspect described in the above-described (6), the first retracting surface in a case of being viewed on a section perpendicular to the first tip end surface, may be a curved surface having a curvature that is equal to or greater than Rmin (mm) defined by a following Equation 1 and that is equal to or less than Rmax (mm) defined by a following Equation 2, or a chamfer having an inclination angle of 45° with respect to a tangent of the first tip end surface, and having a width dimension that is equal to or greater than αmin (mm) defined by a following Equation 3 and that is equal to or less than αmax (mm) defined by a following Equation 4, and the second retracting surface in a case of being viewed on a section perpendicular to the second tip end surface, may be a curved surface having a curvature that is equal to or greater than Rmin (mm) defined by the following Equation 1 and that is equal to or less than Rmax (mm) defined by the following Equation 2, or a chamfer having an inclination angle of 45° with respect to a tangent of the second tip end surface, and having a width dimension that is equal to or greater than αmin (mm) defined by the following Equation 3 and that is equal to or less than αmax (mm) defined by the following Equation 4.

$$R\min=(0.9+0.2e^{-0.08c})(0.3571x^2-0.2595x+0.0965) \quad \text{(Equation 1)}$$

$$R\max=(0.9+0.2e^{-0.08c})(-9.1856x^4+25.17x^3-24.95x^2+11.054x-1.5824) \quad \text{(Equation 2)}$$

$$\alpha\min=0.0222e^{2.08833x}(0.9+0.1e^{-0.07c}) \quad \text{(Equation 3)}$$

$$\alpha\max=(0.9+0.1e^{-0.07c})(-0.3274x^2+0.9768x-0.1457) \quad \text{(Equation 4)}$$

here, e is a base of a natural logarithms, c (mm) indicates a clearance between an inner surface of the die and an outer surface of the punch, and x of the punch is a hardness ratio obtained by dividing the Vicker's hardness of the workpiece by the Vicker's hardness of the punch, x of the die is a hardness ratio obtained by dividing the Vicker's hardness of the workpiece by the Vicker's hardness of the die in the die, and satisfies $0.3 \leq x < 1.0$.

(8) In a case of the above-described (7), one or both of the first retracting surface and the second retracting surface may be a curved surface having a curvature of 0.05 mm to 0.5 mm, or a chamfer distance of C0.05 mm to C0.5 mm.

(9) In the aspect described in any one of the above-described (6) to (8), at least one of a first condition in which a frictional resistance of the first retracting surface is the highest among the first tip end surface, the first retracting surface, and the outer surface of the punch, or a second condition in which a frictional resistance of the second retracting surface is the highest among the second tip end surface, the second retracting surface, and the inner surface of the die, may be satisfied.

Effects of the Invention

According to each of the above-described aspects of the present invention, it is possible to manufacture sheared components at a low cost without generation of a sudden deficiency of a cutting edge, even when a workpiece which is made of high-tension steel or ultra-high-tension steel in which the Vicker's hardness thereof becomes equal to or greater than 0.3 times the Vicker's hardness of a tool is used.

EMBODIMENTS OF THE INVENTION

Embodiments and modification examples regarding a manufacturing method and a manufacturing device of sheared components of the present invention will be described hereinafter.

Figure 1:
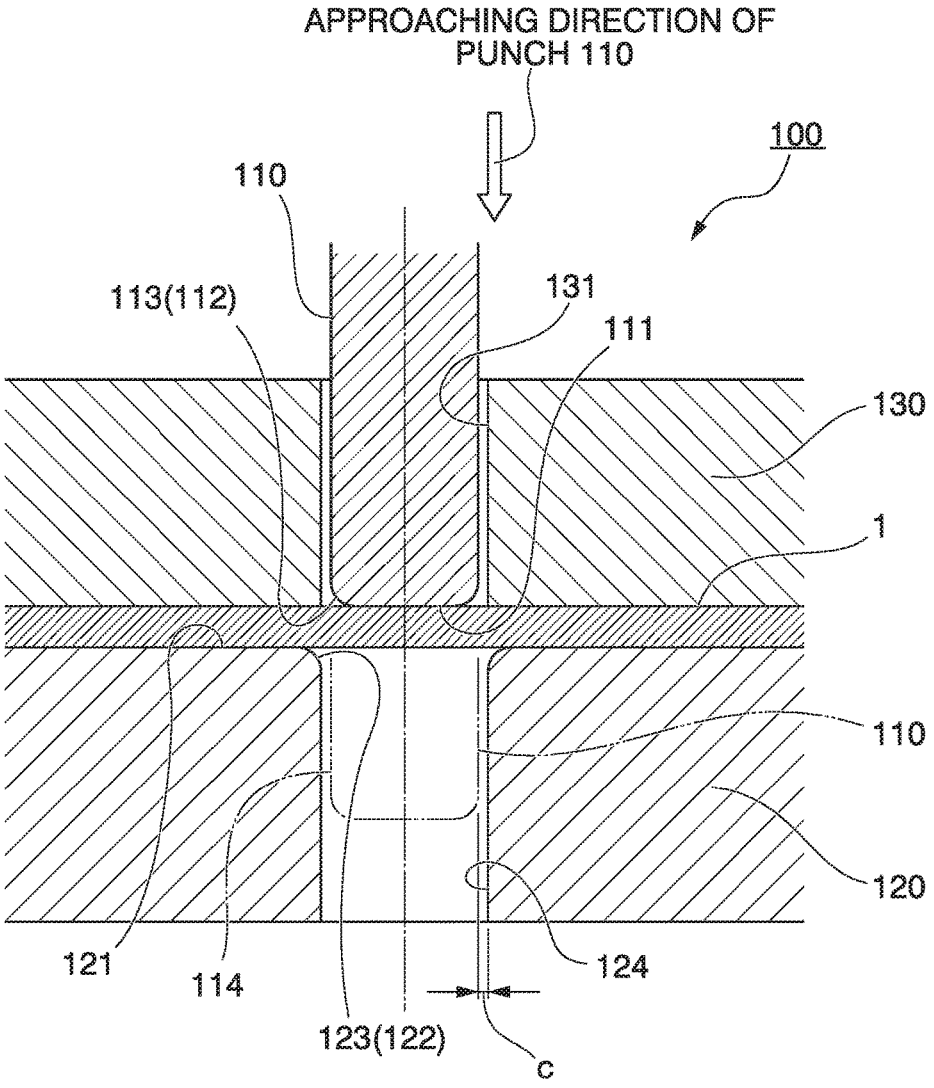
FIG. 1 is a view showing main portions of a shearing device according to an embodiment of the present invention, and is a longitudinal sectional view showing a state where a workpiece is nipped between a die, and a punch and a blank holder.

FIG. 1 shows main portions of a shearing device according to an embodiment of the present invention. As shown in FIG. 1, a manufacturing device of sheared components 100 in the embodiment includes: a die 120 which fix a workpiece 1 by nipping the workpiece 1 vertically and a blank holder 130; and a punch 110 which punches the workpiece 1 relatively approaching the die 120.

The manufacturing device of sheared components 100 is a device which manufactures the plurality of sheared components by performing a shearing a plurality of times on the workpiece 1 consisting of a high-tension steel sheet of which the Vicker's hardness is equal to or greater than 0.3 times and less than 1.0 times the lower one of the Vicker's hardness of the punch 110 and the Vicker's hardness of the die 120.

The punch 110 includes a first cutting edge 113 having a first tip end surface 111 which opposes the workpiece 1 and a first retracting surface 112 which retracts from the first tip end surface 111 considering the approaching direction to the die 120 as a standard. Meanwhile, the die 120 includes a second cutting edge 123 having a second tip end surface 121 which opposes the workpiece 1, and a second retracting surface 122 which retracts from the second tip end surface 121 considering the approaching direction to the punch 110 as a standard.

The die 120 is a pedestal on which the workpiece 1 is loaded, and a through hole 124 which is an inner surface that forms a predetermined clearance c with respect to an outer surface 114 on the section perpendicular to the axial line of the punch 110, in the punch 110, is formed coaxially to the punch 110.

The blank holder 130 is a tool which fixes the workpiece 1 by nipping the workpiece 1 loaded on the die 120 between the blank holder 130 and the die 120, and similar to the die 120, forms a through hole 131 which is coaxial to the punch 110.

A mechanism regarding a deficiency of the tool cutting edge generated when the workpiece of which the Vicker's hardness becomes equal to or greater than 0.3 times the Vicker's hardness of the tool, and which is made of high-tension steel or ultra-high-tension steel (hereinafter, high-tension steel or ultra-high-tension steel is generally called "high-strength steel" in some cases) is sheared, is not known in detail. Here, the mechanism is confirmed by experiment of the inventors. The present invention is completed based on knowledge obtained during the experiment.

First, the inventors performed a tool durability test in a case where the shearing is performed on the workpiece consisting of the high-tension steel sheet having the tensile strength of 780 MPa. As a result of the tool durability test, it was found that the cutting edge is worn away to have a radius which is equal to or greater than 0.05 mm from a state of substantially acute angle until the first 1000-th shot even in a case where the damage of the tool cutting edge does not occur.

At this time, a burr in a shearing portion of the workpiece was fine having the height which is equal to or less than 100 μm regardless that the tool cutting edge has a large roundness. A fact that it is possible to prevent a sudden deficiency of the cutting edge in a state where the cutting edge is round, is disclosed, for example, in the above-described Non-Patent Document 2, but in a case where the steel sheet having the tensile strength of less than 780 MPa (hereinafter, referred to as "mild steel sheet" for convenience) is the workpiece, a fact that a large burr is generated if the cutting edge of any one of the punch and the die necessarily has an acute angle, is known. Accordingly, regarding the mild steel sheet, a fact that a large burr is generated when the cutting edges of both of the punch and the die are rounded or chamfered, is a common general knowledge to those skilled in the art, and a tool having a tool cutting edge of which the cutting quality is not excellent was not widely used. In the related art, since it is generally considered that the workpiece consisting of the high-strength steel is also similar to the mild steel sheet, using a tool cutting edge with a cutting quality which is not excellent has been avoided.

The reason why the burr height of the shearing portion becomes different according to the hardness (or the tensile strength) of the steel sheet, is considered that ductility of the steel sheet becomes different in accordance with the hardness (or the tensile strength) of the steel sheet. Here, in order to investigate a situation of generation of the burr both in a case where the mild steel is used as the workpiece and in a case where the high-strength steel is used as the workpiece, the shearing test shown in FIGS. 2A and 2B was performed.

Figure 2A:
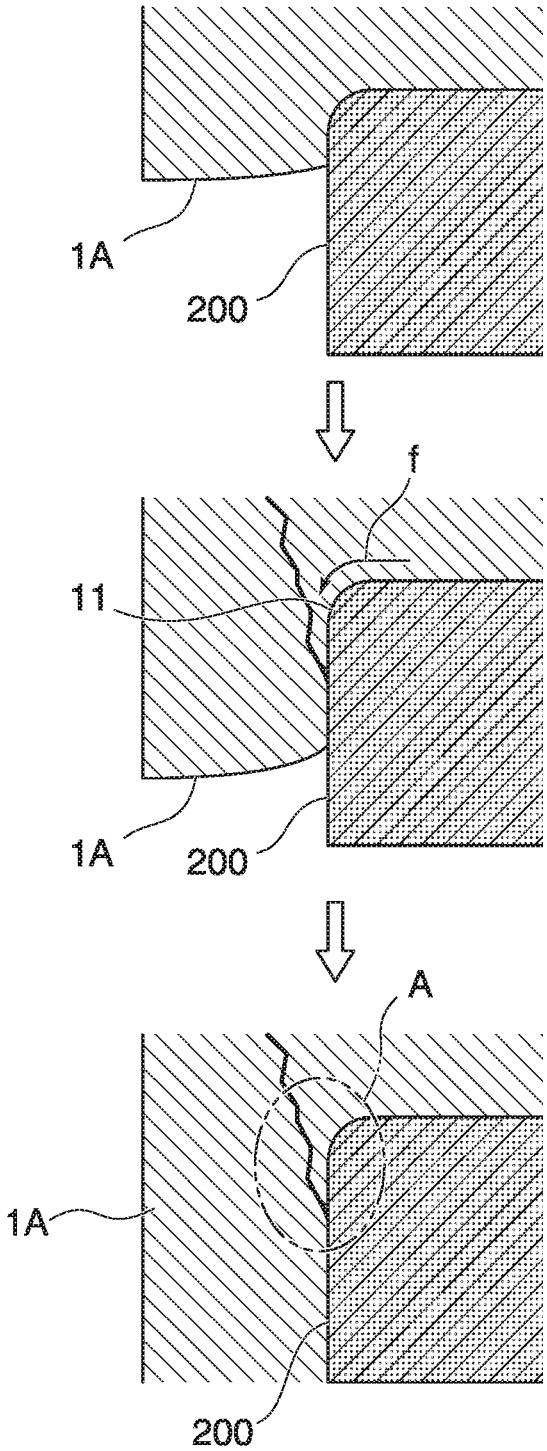
FIG. 2A is a sectional view showing a situation of generation of a burr in a case where shearing is performed on a workpiece consisting of a mild steel sheet of which a tensile strength is less than 780 MPa.
Figure 2B:
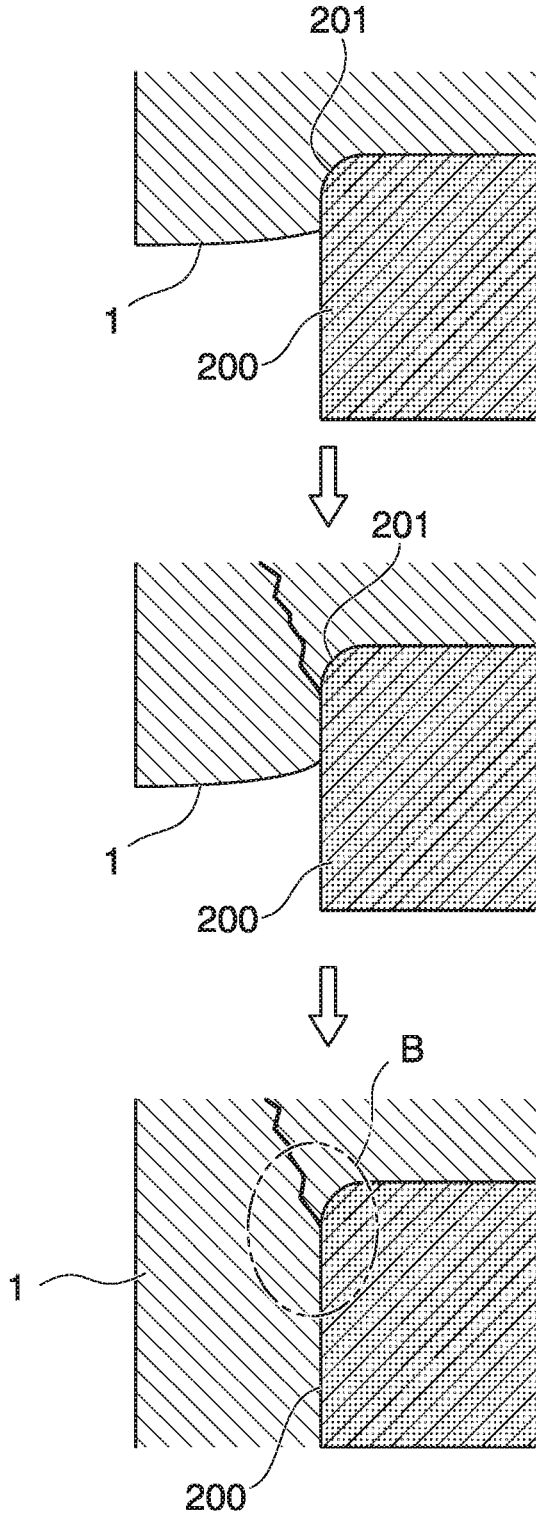
FIG. 2B is a sectional view showing a situation of generation of the burr in a case where the shearing is performed on a workpiece consisting of a high-tension steel sheet of which the tensile strength is equal to or greater than 780 MPa.

FIGS. 2A and 2B are partial sectional views showing the situation of the generation of the burr when the shearing of the steel sheet is performed. FIG. 2A shows a case where a mild steel sheet having a tensile strength of less than 780 MPa is used as a workpiece 1A, and FIG. 2B shows a case where a high-tension steel sheet having a tensile strength of equal to or greater than 780 MPa is used as the workpiece 1.

As shown in FIG. 2A, in a case where the workpiece 1A was the mild steel sheet having the tensile strength of less than 780 MPa in which ductility is high, since breaking occurred after a plastic flow f sufficiently occurred, a burr which is extremely large was generated at a part A when a cutting edge 201 of a tool 200 is round. Meanwhile, as shown in FIG. 2B, in a case where the workpiece 1A was a material which lacks ductility similar to the high-tension steel strength having the tensile strength of equal to or greater than 780 MPa, the plastic flow did not sufficiently occur, and a burr which is fine and which has a height that is not sufficiently high was generated at a part B, even when the cutting edge 201 of the tool 200 is round.

According to the above-described test result, it was assumed that the burr height of the shearing portion becomes different in accordance with the hardness (or the tensile strength) of the steel sheet because the ductility of the steel sheet becomes different.

It was confirmed that a more detailed mechanism when shearing the high-tension steel sheet and when the cutting edge of the die and the cutting edge of the punch are deficient, is supposed to be specified, and how the cutting edge of the die and the cutting edge of the punch become deficient was determined, by experiment.

The result will be described by using FIGS. 3A to 3C. In the experiment, the workpiece 1 consisting of the high-tension steel sheet having the tensile strength of equal to or greater than 780 MPa was sheared by a punch 300 and a die 310 which each have a tool cutting edge having an acute angle.

Figure 3A:
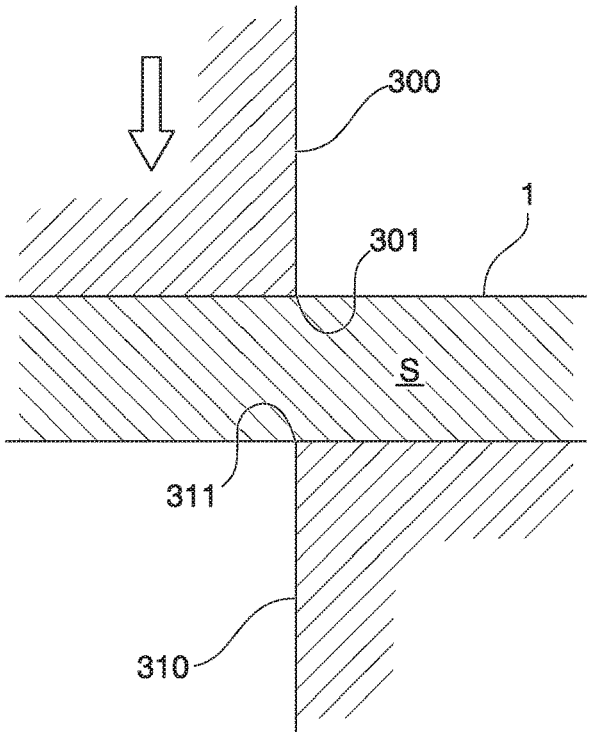
FIG. 3A is a view explaining a detailed mechanism when the shearing is performed on a workpiece consisting of the high-tension steel sheet, and when a cutting edge of the die and a cutting edge of the punch are deficient, and is a sectional view when the shearing is started.

FIG. 3A is a partial sectional view showing an initial process when drilling the workpiece (high-tension steel sheet) 1 by the punch 300 and the die 310, and shows a situation in which the punch 300 approaches the die 310 as shown by an outlined arrow. In addition, as shown in FIG. 3A, both of a cutting edge 301 of the punch 300 and a cutting edge 311 of the die 310 have a sectional shape having an orthogonal angle in the initial process.

Figure 3B:
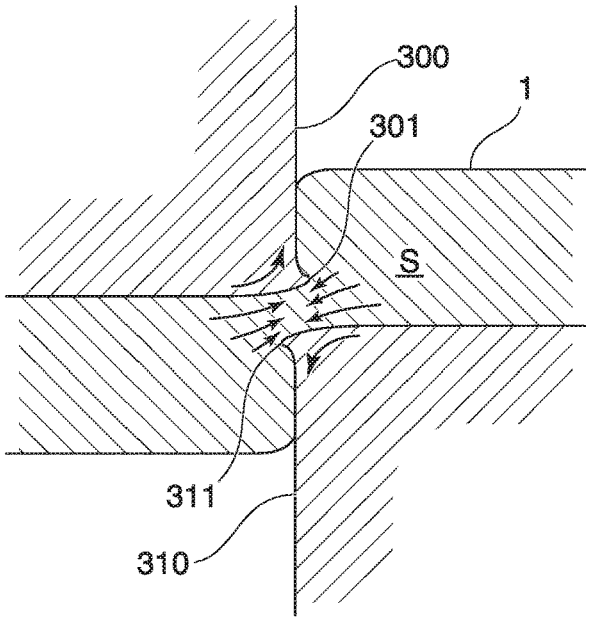
FIG. 3B is a view explaining a detailed mechanism when the shearing is performed on a workpiece consisting of the high-tension steel sheet, and when the cutting edge of the die and the cutting edge of the punch are deficient, and is a sectional view showing a process following FIG. 3A.

FIG. 3B is a partial sectional view showing a state where the punch 300 is closer to the die 310 than that of FIG. 3A. When the workpiece 1 between the punch 300 and the die 310 is sheared, considering a straight line which links the cutting edges 301 and 311 to each other as a boundary, plastic flows which are oriented from one side of the workpiece 1 to the other side, and from the other side to one side, are formed. In the plastic flows, a pressure is particularly high between the cutting edges 301 and 311 in which a flow path becomes narrow, and the cutting edges 301 and 311 are plastically deformed as the cutting edges 301 and 311 are pressed to push along the flows thereof.

Figure 3C:
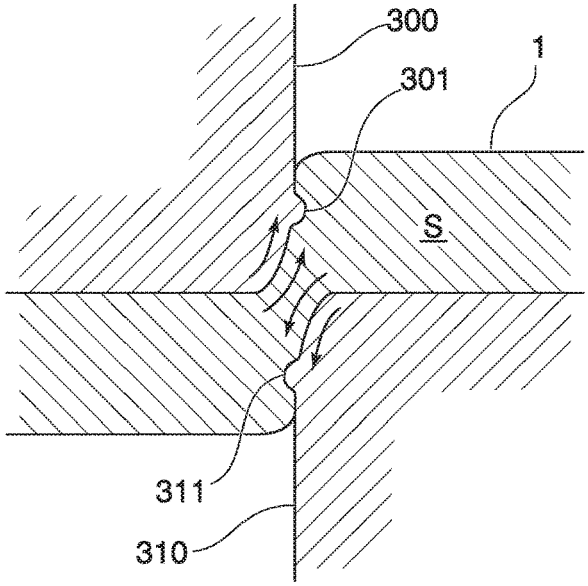
FIG. 3C is a view explaining a detailed mechanism when the shearing is performed on a workpiece consisting of the high-tension steel sheet, and when the cutting edge of the die and the cutting edge of the punch are deficient, and is a sectional view showing a process following FIG. 3B.

As a result, the cutting edges 301 and 311 become projections which further protrude than original positions, but when the punch 300 further approaches the die 310 and a process of FIG. 3C is achieved, the cutting edge 301 receives a pressing force due to the plastic flow and moves to an outer surface of the punch 300, and finally, the cutting edge 301 becomes deficient. Similarly, the cutting edge 311 also receives the pressing force due to the plastic flow and moves to an inner surface of the die 310, and finally, the cutting edge 311 becomes deficient.

As a reason why the deficiency of the cutting edges 301 and 311 is generated, the following was assumed. First, an interval between the cutting edges 301 and 311 becomes narrower according to the progress of the shearing, and the plastic flow is formed as described above. At this time, if the workpiece 1 is mild steel, since the workpiece 1 is not hard, before loading high stress onto the cutting edges 301 and 311, the plastic flow passes through between the cutting edges 301 and 311.

However, in a case where the workpiece 1 is the high-tension steel sheet, it is not possible to largely and freely move including a part which abuts against the cutting edges 301 and 311 due to the hardness. Therefore, in the workpiece 1, the part which abuts against the cutting edges 301 and 311 is placed in a state of maintaining a high pressure and being stopped, continues to load high stress onto the cutting edges 301 and 311, and finally, is plastically deformed so that each of the cutting edges 301 and 311 is further pushed out than the original positions.

Next, the cutting edge 301 which is pushed out to the outer surface of the punch 300 receives a shearing force due to relative dislocation from the workpiece 1 on the periphery of the punch 300, and becomes deficient. Similarly, the cutting edge 311 which is pushed out to the inner surface of the die 310 also receives a shearing force due to relative dislocation from the workpiece 1 in the die 310, and becomes deficient.

As a result of examining the above-described experiment result, it was determined that active employment of rounding or chamfering which is avoided in mild steel with respect to the cutting edge of the tool, that is, both of the cutting edge 301 of the punch 300 and the cutting edge 311 of the die 310, is effective since a burr which is extremely large due to a sudden deficiency of the cutting edge of the tool is suppressed, when a workpiece which is made of high-tension steel or ultra-high-tension steel in which the Vicker's hardness thereof becomes equal to or greater than 0.3 times the Vicker's hardness of a tool is sheared.

In addition, the inventors tried detailed examination regarding the size of the roundness or the chamfer of the tool cutting edge. Hereinafter, the examination result will be described.

Figure 4:
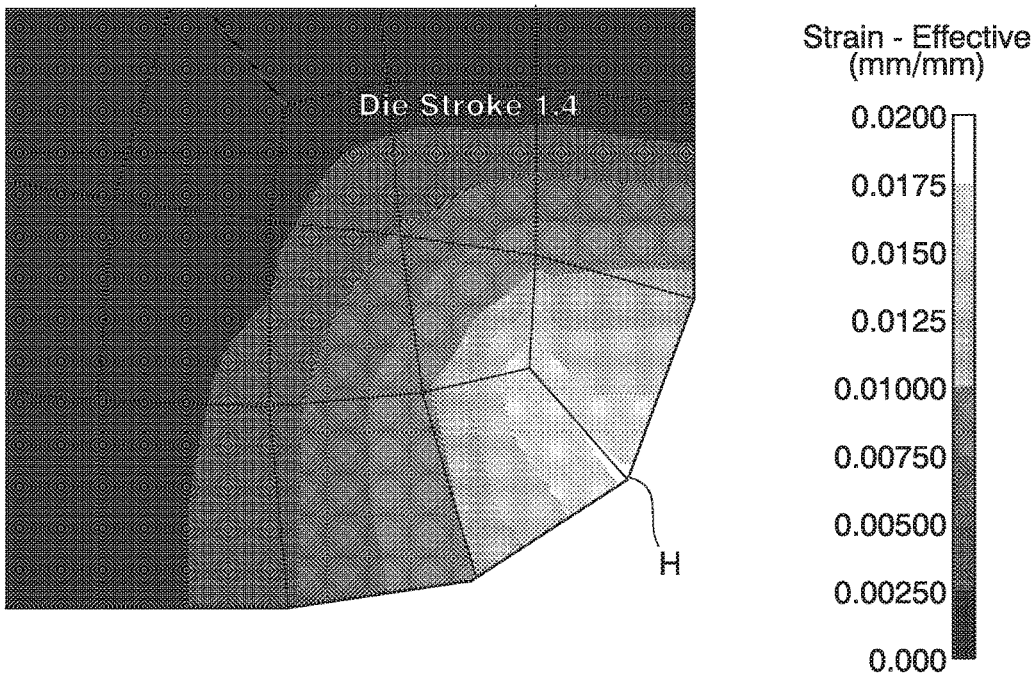
FIG. 4 is a view showing a result of size distribution of plastic deformation amounts in a tool cutting edge obtained by simulation calculation.

First, a radius of curvature in a case where the tool cutting edge is rounded, was examined. Specifically, after setting each of a Vicker's hardness Hw of the workpiece, a Vicker's hardness Ht of the tool, and the clearance c between the tools (between the punch and the die), the plastic deformation amount generated at the tool cutting edge was calculated by using simulation. An example of the simulation calculation result is shown in FIG. 4. In the example of FIG. 4, the sizes of the plastic deformation amount are distinguished by colors, and the plastic deformation amount becomes the maximum at a location of correspondence H which is an endmost cutting edge tip. When the plastic deformation amount exceeds an allowable range, the calculation was performed again by increasing the radius of curvature of the roundness at the tool cutting edge, and the minimum radius of curvature of the roundness that satisfies a condition that the plastic deformation amount is within the allowable range, was obtained. In addition, the obtained minimum radius of curvature of the roundness is the minimum value Rmin of the roundness (R value) in the above-described setting.

The above-described simulation calculation was performed while changing each combination of the Vicker's hardness Hw of the workpiece, the Vicker's hardness Ht of the tool, and the clearance c between the tools. The result thereof is shown in the following Table 2.

[Table 2]

In addition, based on the simulation calculation result of the above Table 2, the above-described Rmin was obtained as the following (Equation 1) which is a function of the hardness ratio x and the clearance c between the tools.

$$R\text{min}=(0.9+0.2e^{-0.08c})(0.3571x^2-0.2595x+0.0965) \quad \text{(Equation 1)}$$

here, the unit of Rmin is (mm), and e is the base of the natural logarithms.

In addition, c (mm) is the clearance between the tools and indicates the clearance between the inner surface of the die and the outer surface of the punch in a case of a drilling tool.

In addition, x indicates x=Hw/Ht which is a dimensionless number obtained by dividing the Vicker's hardness Hw (MPa) of the workpiece by the Vicker's hardness Ht (MPa) of the tool, and becomes a value which satisfies $0.3 \leq x < 1.0$ due to the reasons which will be described later. For example, in a case of the drilling tool, x of the punch is a hardness ratio obtained by dividing the Vicker's hardness of the workpiece by the Vicker's hardness of the punch, and x of the die is a hardness ratio obtained by dividing the Vicker's hardness of the workpiece by the Vicker's hardness of the die in the die.

The reason why a lower limit value of the hardness ratio x is 0.3 ($0.3 \leq x$) is that a target to be employed of the present invention is the workpiece of which the ratio is equal to or greater than 0.3 times as described based on the experiment result of Table 1. In addition, the reason why an upper limit value of the hardness ratio x is less than 1.0 ($x<1.0$) is that hardness balance is reversed and the processing cannot be performed when the Vicker's hardness Hw of the workpiece exceeds the Vicker's hardness Ht of the tool. Due to the above-described reasons, the hardness ratio becomes a value that satisfies $0.3 \leq x < 1.0$.

In order to verify validity of the above-described Equation 1 obtained based on the simulation calculation result, the inventors performed the tool durability test repeating the drilling of a hole having a diameter of 10 mm respectively with respect to (1) a case where the cutting edges of both of the punch and die have an acute angle, (2) a case where the cutting edges of both of the punch and die are rounded to have a radius of 0.01 mm, (3) a case where the cutting edges of both of the punch and die are rounded to have a radius of 0.04 mm, (4) a case where the cutting edges of both of the punch and die are rounded to have a radius of 0.05 mm, (5) a case where the cutting edges of both of the punch and die are rounded to have a radius of 0.50 mm, (6) a case where the cutting edges of both of the punch and die are rounded to have a radius of 0.60 mm, and (7) a case where the cutting edges of both of the punch and die are rounded to have a radius of 1.00 mm.

As the workpiece, three types of steel sheets, such as a mild steel sheet having a tensile strength of 270 MPa, a steel sheet having a tensile strength of 590 MPa, and a high-tension steel sheet having a tensile strength of 780 MPa, were used. In addition, by setting the clearance between the punch and the die to be 15% t (% t indicates a proportion of the clearance width with respect to the sheet thickness of the workpiece. In this example, when the sheet thickness of the workpiece is t (mm), the clearance becomes 0.15×t (mm)), the drilling was continuously performed to the maximum 20000 shots.

Figure 5:
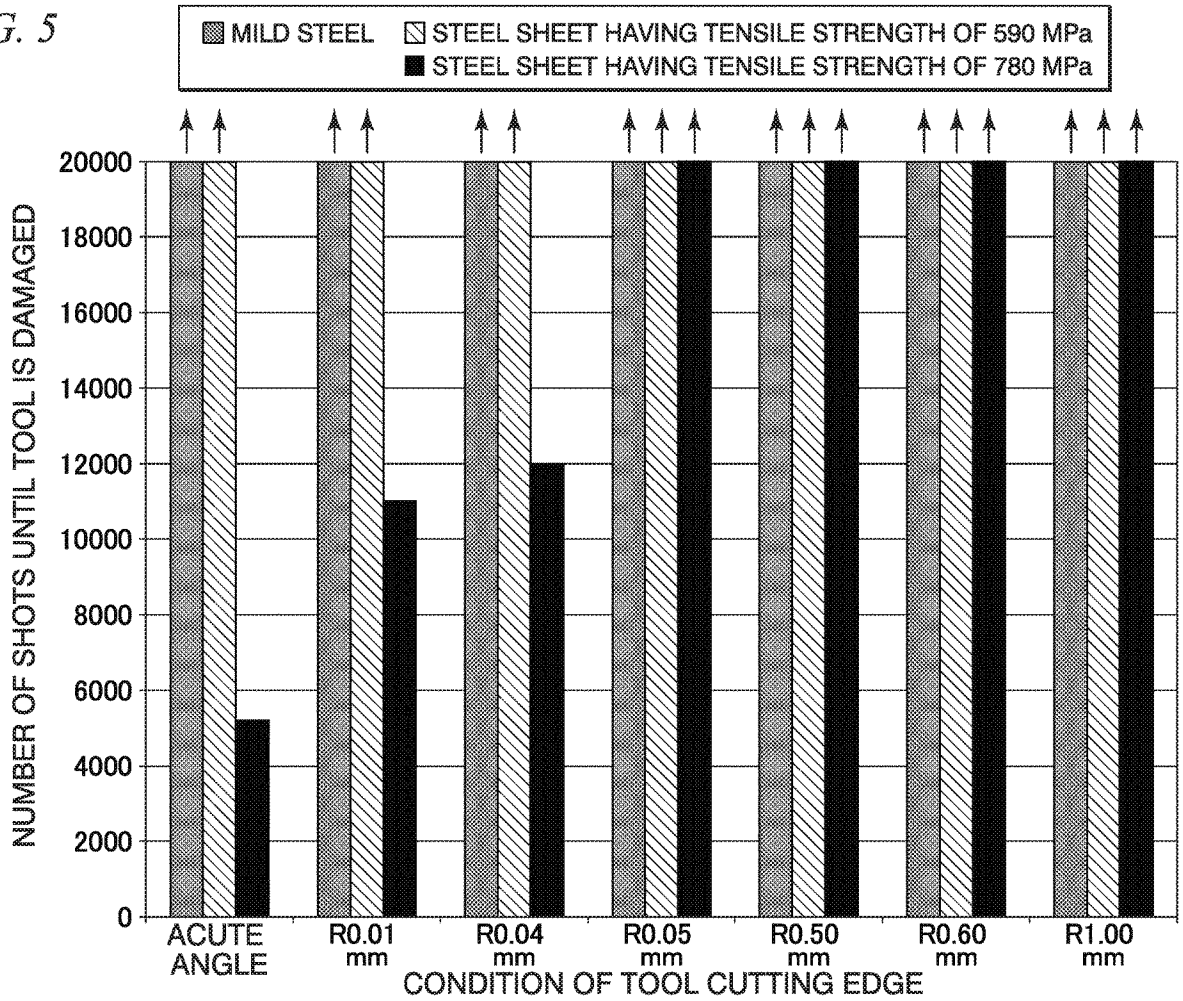
FIG. 5 is a bar graph showing the number of shots when drilling is continuously performed on workpieces consisting of three types of steel until the tool cutting edge is damaged. The horizontal axis indicates the radius of curvature of a roundness of the tool cutting edge, and the vertical axis indicates the number of shots.

FIG. 5 is a bar graph showing the number of shots until the tool cutting edge is damaged.

As shown in FIG. 5, in a case where the mild steel sheet (in which a tensile strength is 270 MPa) or the steel sheet having a tensile strength of 590 MPa is used as the workpiece, even in any tool condition of the roundness dimension, the tool cutting edge was not damaged (an arrow in FIG. 5 indicates that there is not damage even after the 20000-th shot. Hereinafter, this is similar in bar graphs of other drawings). When the high-tension steel sheet having the tensile strength of 780 MPa is used as the workpiece, damage of the tool cutting edge was generated in a case where the tool cutting edge has an acute angle, in a case of R0.01 mm, and in a case where R0.04 mm. On the other hand, even when the high-tension steel sheet having the tensile strength of 780 MPa is used as the workpiece, damage of tool cutting edge was not generated in a case of R0.05 mm to R1.00 mm which is an example of the present invention. In addition, the Vicker's hardness of the tool used was 653 Hv, the Vicker's hardness of the mild steel sheet was 82 Hv, the Vicker's hardness of the steel sheet having a tensile strength of 590 MPa was 184 Hv, and the Vicker's hardness of the high-tension steel sheet having a tensile strength of 780 MPa was 245 Hv. In addition, the corresponding relation between the each of steel sheet and the Vicker's hardness value is similar in other experiments described in the embodiment.

More specifically, as shown in FIG. 5, compared to a case of the above-described (1) to (3) in which the radius of the roundness is equal to or less than 0.04 mm, in a case of the above-described (4) to (7) in which the radius of the roundness is equal to or greater than 0.05 mm, remarkable extension of the tool service life was confirmed. Understandably, a burr which is extremely large caused by a sudden deficiency of the tool cutting edge was also not generated.

Even in the simulation calculation result which obtains the above-described Equation 1 described above, it was confirmed that the plastic deformation amount is suppressed by setting the radius of the roundness to be equal to or greater than 0.05 mm. Therefore, based on the above-described Equation 1, it was confirmed that it is effective to estimate the lower limit value Rmin of the roundness of the cutting edge.

Next, the upper limit value Rmax of the roundness of the tool cutting edge was examined.

When the roundness dimension of the tool cutting edge is more than necessary too large, since there is a tendency that the height dimension of the burr generated in the workpiece after the shearing becomes higher than that allowed, the upper limit value was determined based on the roundness dimension which corresponds to the burr height which can be allowed. Specifically, in each case of the above-described (1) to (7), the shearing was performed, and the burr height was obtained at each predetermined number of shots.

Figure 6A:
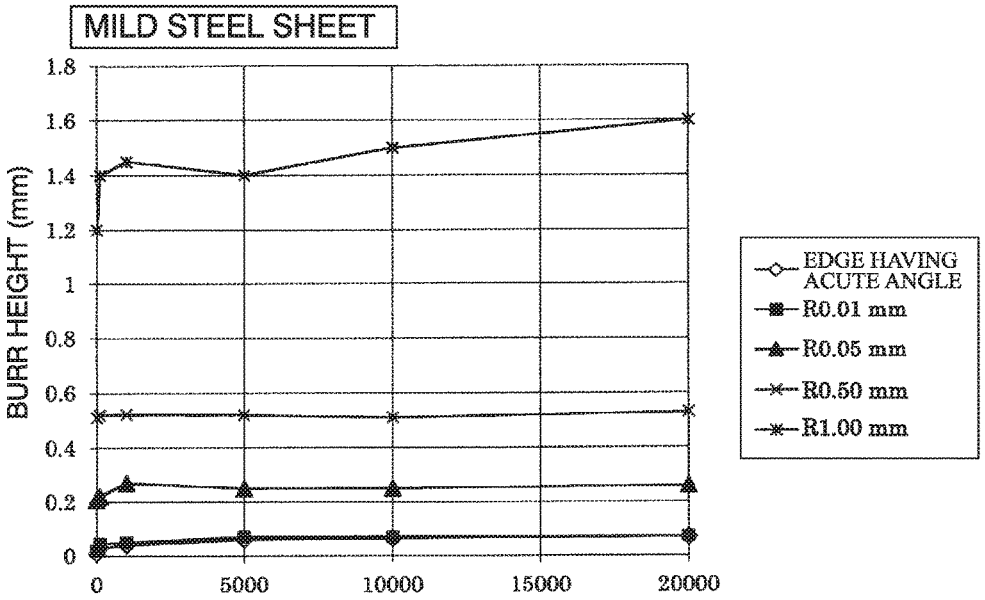
FIG. 6A is a graph showing transition of the height of the burr when the drilling is continuously performed on a workpiece consisting of the mild steel sheet according to the number of shots.
Figure 6B:
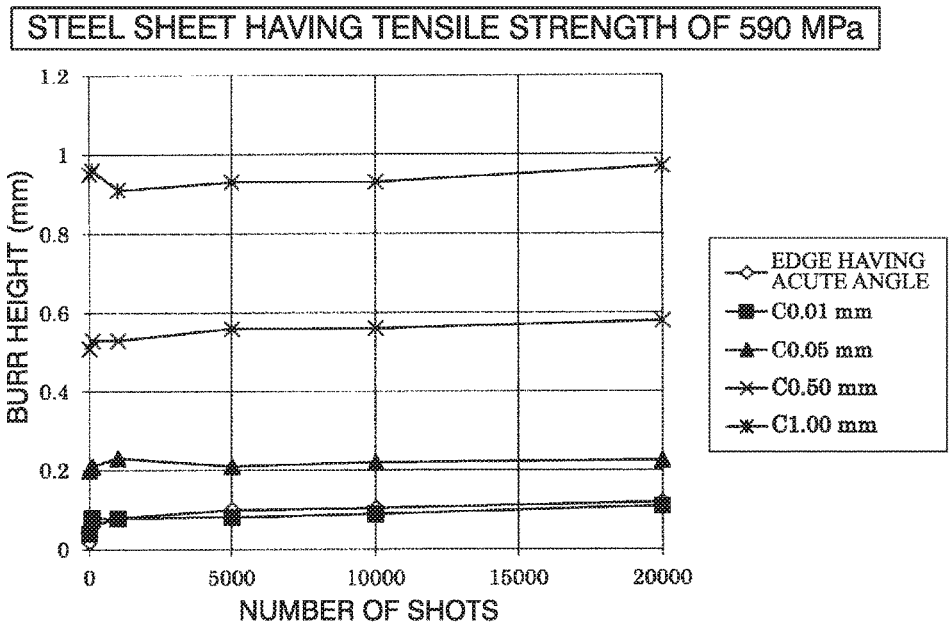
FIG. 6B is a graph showing transition of the height of the burr when the drilling is continuously performed on a workpiece consisting of a steel sheet having a tensile strength of 590 MPa according to the number of shots.
Figure 6C:
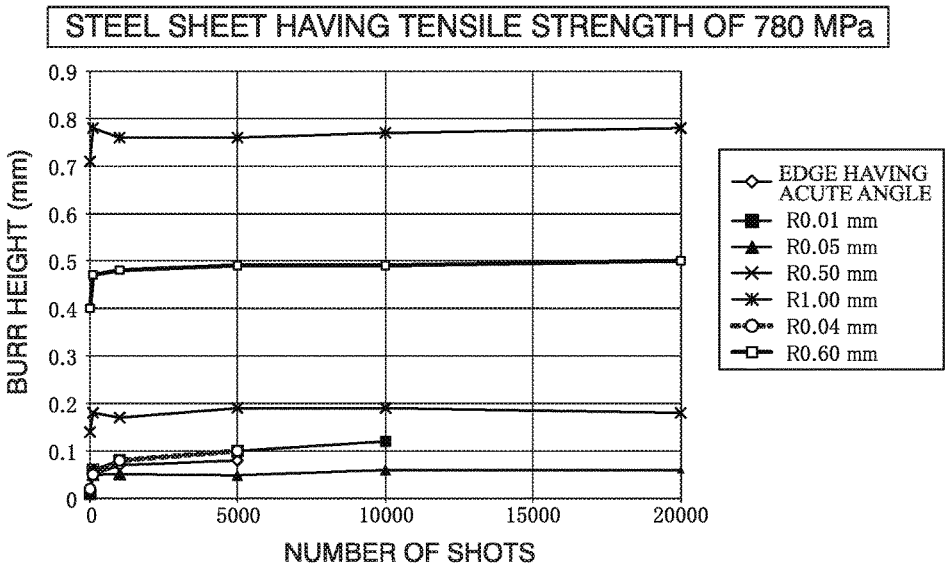
FIG. 6C is a graph showing transition of the height of the burr when the drilling is continuously performed on a workpiece consisting of a high-tension steel sheet having 780 MPa according to the number of shots.

In FIGS. 6A to 6C, an aspect in which the burr height in a hole portion formed by the continuous drilling transits according to the number of shots is shown by graphs. FIG. 6A is a graph in a case where the mild steel sheet is the workpiece. FIG. 6B is a graph in a case where the steel sheet having a tensile strength of 590 MPa is the workpiece. FIG. 6C is a graph in a case where the high-tension steel sheet having a tensile strength of 590 MPa is the workpiece. In addition, among the workpieces, one that is considered as a target of the present invention is the high-tension steel sheet having a tensile strength of 780 MPa shown in FIG. 6C, and FIGS. 6A and 6B are shown as a reference.

As shown in FIGS. 6A and 6B, in a case where the mild steel sheet or the steel sheet having a tensile strength of 590 MPa is the workpiece, a case where the tool cutting edge has an acute angle or rounded to have R0.01 mm is excluded, and the burr height is equal to or greater than 0.2 mm through all of the number of shots.

Meanwhile, as shown in FIG. 6C, in a case where the high-tension steel sheet having the tensile strength of 780 MPa is the workpiece, it was possible to suppress the burr height to be equal to or less than 0.2 mm when the roundness of the tool cutting edge is equal to or less than 0.5 mm, but when the roundness of the tool cutting edge is equal to or greater than 0.6 mm, it was confirmed that the burr height has suddenly increased.

More specifically, as shown in FIG. 6C, in a case of (6) and (7) in which the radius of curvature of the roundness is equal to or greater than 0.6 mm, the burr height was not limited to within the allowable range, but in a case of (2) to (5) in which the radius of curvature of the roundness is equal to or less than 0.5 mm, it was confirmed that the burr height is limited to be within the allowable range.

Receiving the experiment result of FIG. 6C, an experiment that a tendency of the maximum value Rmax of the radius of curvature of the roundness of the tool cutting edge is obtained in which the burr height can be suppressed, was performed, when the high-tension steel or the ultra-high-tension steel having the tensile strength of equal to or greater than 780 MPa is used as the workpiece, and with respect to a case where a combination of the Vicker's hardness Hw of the same workpiece, the Vicker's hardness Ht of the tool, and the clearance c between the tools (between the punch and the die) is changed.

In other words, when the high-tension steel or the ultra-high-tension steel is used as the workpiece, after setting a plurality of combinations of the Vicker's hardness Hw of the same workpiece, the Vicker's hardness Ht of the tool, and the clearance c between the tools (between the punch and the die), the drilling was continuously performed by setting the upper limit to be 20000 shots with respect to each of the cases. In addition, under each setting condition, the maximum value of the radius of curvature of the roundness of the tool cutting edge of which the burr height is limited to be equal to or less than 0.2 mm, was obtained as the Rmax. The result thereof is shown in the following Table 3.

[Table 3]

In addition, based on the experiment result of the above Table 3, the above-described Rmax is obtained as the following (Equation 2) which is a function of the hardness ratio x and the clearance c between the tools.

$$Rmax=(0.9+0.2e^{-0.08c})(-9.1856x^4+25.17x^3-24.95x^2+11.054x-1.5824) \quad \text{(Equation 2)}$$

here, the unit of Rmax is (mm), and the hardness ratio x and the clearance c is the same as that described in the above-described (Equation 1).

According to the above-described experiment result, in a case where the high-tension steel including the 780 MPa grade steel is the workpiece, it was confirmed that it is necessary for the radius of curvature of the tool cutting edge to be 0.05 mm to 0.5 mm so that the burr height to be generated is fine to an allowable degree and a sudden deficiency of the tool cutting edge is not generated. In addition, in a case where the target of the workpiece is in a wider range including the ultra-high-tension steel, by setting the radius of curvature of the tool cutting edge to be within a range of the Rmin to the Rmax, it was confirmed that the burr to be generated is fine to an allowable degree and a sudden deficiency of the tool cutting edge is not generated.

In addition, when a shearing sequence is started, as means for rounding the tool cutting edge of both of the punch and the die to have a radius of 0.05 mm to 0.5 mm or the Rmin to the Rmax, grinding or the like using an NC working machine is shown as an example.

Accordingly, in the manufacturing device of sheared components 100 which includes the punch 110 and the die 120, and which mass-produces the sheared components by continuously performing the shearing with respect to multiple high-tension steel sheets of which the maximum tensile strength is equal to or greater than 780 MPa grade and which are used as the workpiece 1, it is preferable that the tool cutting edges 113 and 123 of both of the punch 110 and the die 120 are rounded to have a radius of 0.05 mm to 0.5 mm, when a shearing sequence is started. Furthermore, in a case where the target of the workpiece 1 is also within a wider range than the range including the ultra-high-tension steel, it is preferable that the radius of the tool cutting edges 113 and 123 is within a range of the Rmin to the Rmax.

According to the manufacturing device of sheared components 100 which includes the punch 110 and the die 120 having the above-described configuration, in a case where the shearing is continuously performed with respect to the multiple steel sheets, such as the high-tension steel sheet having the maximum tensile strength of equal to or greater than 780 MPa grade, or the ultra-high-tension steel having the maximum tensile strength greater than 780 MPa grade the burr to be generated is fine to an allowable degree, a sudden deficiency of the tool cutting edges 113 and 123 is not generated, and it is possible to mass-produce the sheared components.

Next, a case where a chamfer C is applied to the tool cutting edge was also examined. Specifically, after assuming that the Vicker's hardness Hw of the workpiece, the Vicker's hardness Ht of the tool, and the clearance c between the tools (between the punch and the die) are each certain values, the plastic deformation amount generated in the tool cutting edge was calculated by simulation. Similar to FIG. 4 described above, the results of the simulation calculation are distinguished by colors in accordance with the size of the plastic deformation amount (since the results are similar to that shown in FIG. 4, the figure was omitted).

Here, if the maximum value of the plastic deformation amount exceeds the allowable range, the calculation was performed again by increasing the chamfer dimension C in the tool cutting edge, and the chamfer dimension C which satisfies the condition in which the plastic deformation amount becomes within the allowable range, was obtained. In addition, the obtained chamfer dimension C is set to the minimum value αmin in the above-described setting.

Figure 7:
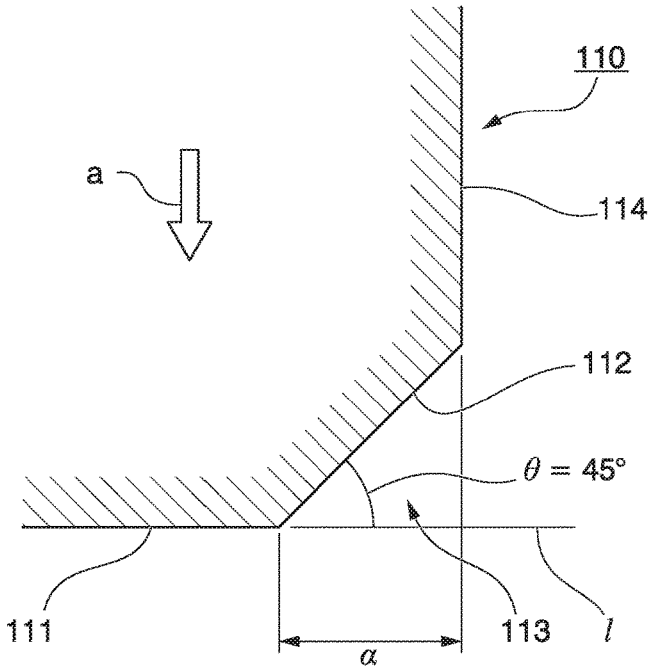
FIG. 7 is a view showing a sectional shape in a case where the tool cutting edge is chamfered, and is a sectional view of main portions of the punch.

In addition, the corresponding relation of each dimension of the chamfer C is as shown in FIG. 7. In FIG. 7, an outlined arrow a indicates the moving direction of the punch 110, a correspondence 1 indicates a tangent of the tip end surface 111 (first tip end surface) of the punch 110, a correspondence 112 indicates the chamfer which is the first retracting surface, and a correspondence 114 indicates the side surface (outer surface).

An inclination angle θ with respect to the tangent 1 of the tip end surface 111 is set to be 45°. After additionally examining the θ, it was confirmed that the influence of the θ on the αmin is small, when the θ is within a range of $10°<\theta<60°$. Therefore, after fixing θ=45° for reducing the variable and making it easy to handle data, while changing each of the combinations of the Vicker's hardness Hw of the workpiece, the Vicker's hardness Ht of the tool, and the clearance c between the tools, the above-described simulation calculation was performed. The result thereof is shown in the following Table 4.

[Table 4]

In addition, based on the simulation result of the above Table 4, the above-described αmin was obtained as the following (Equation 3) which is a function of the hardness ratio x and the clearance c between the tools.

$$\alpha min=0.0222e^{2.0833x}(0.9+0.1e^{-0.07c}) \quad \text{(Equation 3)}$$

here, e is the base of natural logarithms.

In addition, c (mm) indicates a clearance between the inner surface 124 of the die 120 and the outer surface 114 of the punch 110.

In addition, x indicates x=Hw/Ht which is a dimensionless number obtained by dividing the Vicker's hardness Hw (MPa) of the workpiece 1 by the Vicker's hardness Ht (MPa) of the tool, and becomes a value which satisfies $0.3 \leq x < 1.0$ due to the above-described reasons. For example, in a case of the drilling tool, x of the punch 110 is a hardness ratio obtained by dividing the Vicker's hardness of the workpiece 1 by the Vicker's hardness of the punch 110, x of the die 120 is a hardness ratio obtained by dividing the Vicker's hardness of the workpiece 1 by the Vicker's hardness of the die 120.

In order to verify validity of the above-described Equation 3 obtained based on the simulation calculation result, the inventors performed the tool durability test considering the continuous drilling of a hole having a diameter of 10 mm as a target respectively with respect to (8) a case where the cutting edges of both of the punch 110 and die 120 have an acute angle, (9) a case where the cutting edges of both of the punch and die are chamfered to have a chamfer distance of C0.01 mm, (10) a case where the cutting edges of both of the punch and die are chamfered to have a chamfer distance of C0.04 mm, (11) a case where the cutting edges of both of the punch and die are chamfered to have a chamfer distance of C0.05 mm, (12) a case where the cutting edges of both of the punch and die are chamfered to have a chamfer distance of C0.50 mm, (13) a case where the cutting edges of both of the punch and die are chamfered to have a chamfer distance of C0.60 mm, and (14) a case where the cutting edges of both of the punch and die are chamfered to have a chamfer distance of C1.00 mm.

As the workpiece, three types of steel sheets, such as a mild steel sheet having a tensile strength of 270 MPa, a steel sheet having a tensile strength of 590 MPa, and a high-tension steel sheet having a tensile strength of 780 MPa, were used. In addition, by setting the clearance between the punch and the die to be 15% t (% t indicates a proportion of the clearance width with respect to the sheet thickness of the workpiece. In this example, when the sheet thickness of the workpiece is t (mm)), the clearance becomes 0.15×t (mm), the drilling is continuously performed to the maximum 20000 shots.

Figure 8:
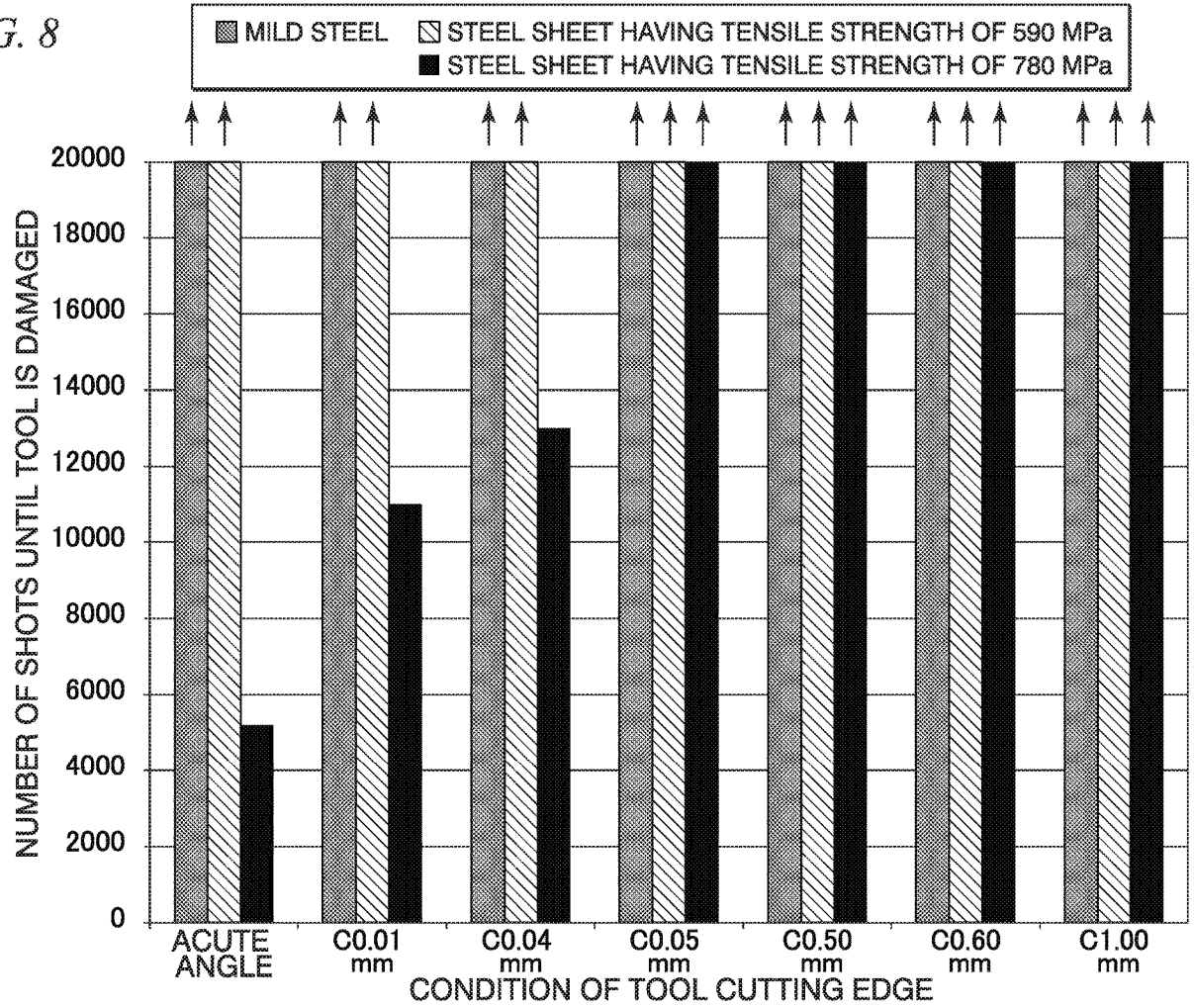
FIG. 8 is a bar graph showing the number of shots when the drilling is continuously performed on workpieces consisting of three types of steel until the tool cutting edge is damaged, the horizontal axis indicates the chamfering dimension of the tool cutting edge, and the vertical axis indicates the number of shots.

FIG. 8 is a bar graph showing the number of shots until the tool cutting edge is damaged.

As shown in FIG. 8, when the mild steel sheet or the steel sheet having a tensile strength of 590 MPa is used as the workpiece, even in any chamfer condition, the tool cutting edge was not damaged. When the high-tension steel sheet having a tensile strength of 780 MPa grade is used as the workpiece, damage of the tool was generated in a case where the tool cutting edge has an acute angle, in a case where the chamfer distance is C0.01 mm and in a case where the chamber distance is C0.04 mm. On the other hand, even when the high-tension steel sheet having a tensile strength of 780 MPa grade is used as the workpiece, damage of the tool cutting edge was not generated in a case of C0.05 mm to C1.00 mm which is an example of the present invention.

More specifically, as shown in FIG. 8, compared to a case of the above-described (8) to (10) in which the chamfer distance is equal to or less than C0.04 mm, in a case of the above-described (11) to (14) in which the chamfer distance is equal to or greater than C0.05 mm, remarkable extension of the tool service life was confirmed. Understandably, a burr which is extremely large caused by a sudden deficiency of the tool cutting edge was also not generated.

Even in the simulation calculation result which obtains the above-described Equation 3 described above, it was confirmed that the plastic deformation amount can be suppressed by setting the chamfer to be equal to or greater than C0.05 mm. Therefore, based on the above-described Equation 3, it was confirmed that it is effective to estimate the lower limit value $\alpha$min of the chamfer dimension of the tool cutting edge.

Next, the upper limit value $\alpha$max of the chamfer dimension of the tool cutting edge was examined.

In other words, when the chamfer dimension of the tool cutting edge is extremely large as necessary, since there is a tendency that the height dimension of the burr generated in the workpiece after the shearing becomes higher than that allowed, the upper limit value was determined based on the chamfer dimension which corresponds to the burr height which can be allowed. Specifically, in each case of the above-described (8) to (14), the shearing was performed, and the burr height was obtained at each predetermined number of shots.

Figure 9A:
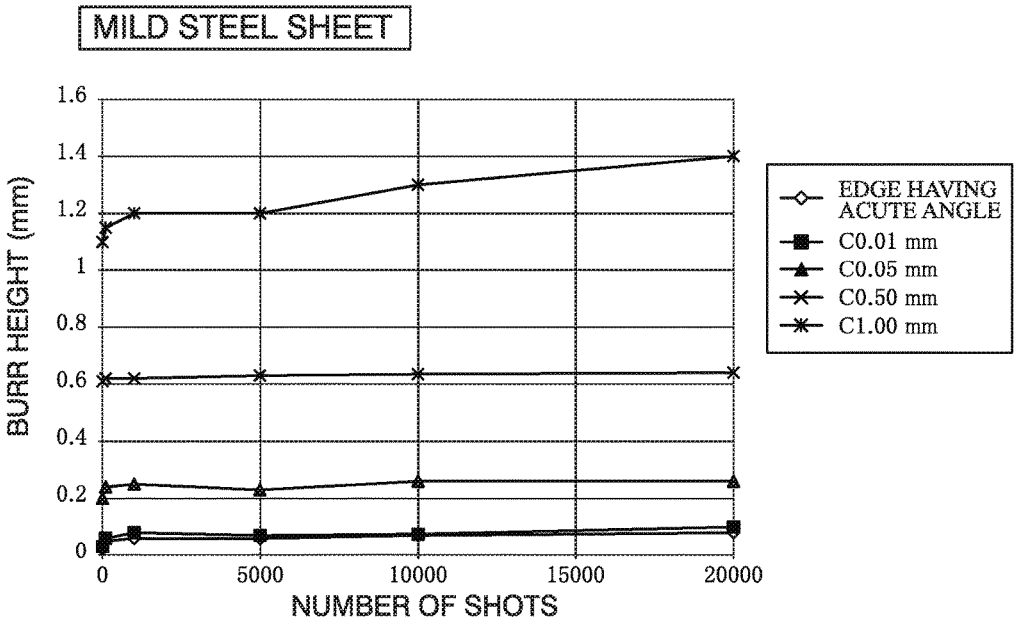
FIG. 9A is a graph showing transition of the height of the burr when the drilling is continuously performed on a workpiece consisting of the mild steel sheet according to the number of shots.
Figure 9B:
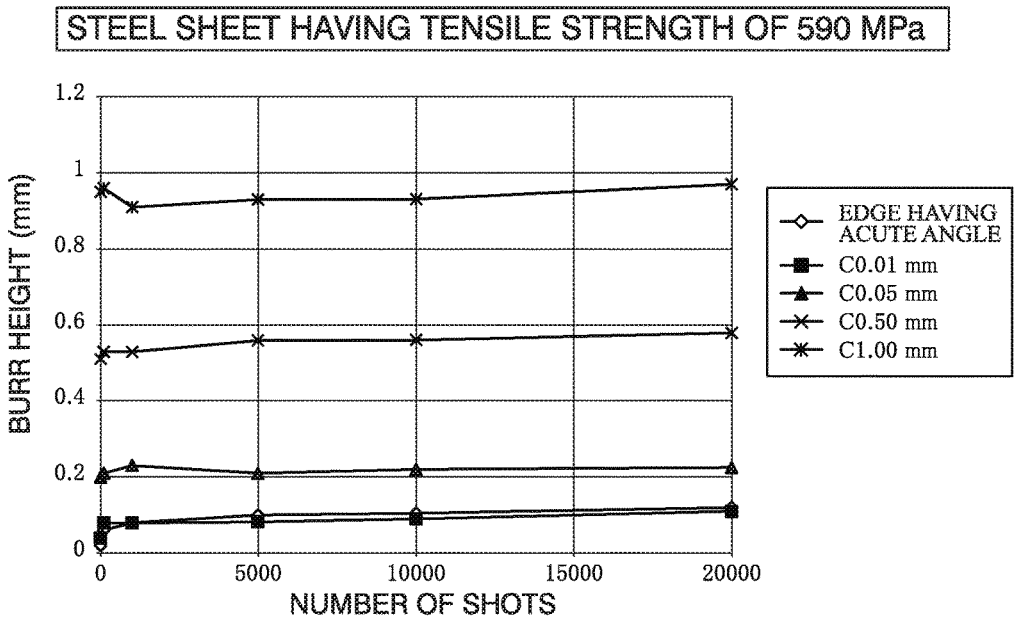
FIG. 9B is a graph showing transition of the height of the burr when the drilling is continuously performed on a workpiece consisting of a steel sheet having a tensile strength of 590 MPa according to the number of shots.
Figure 9C:
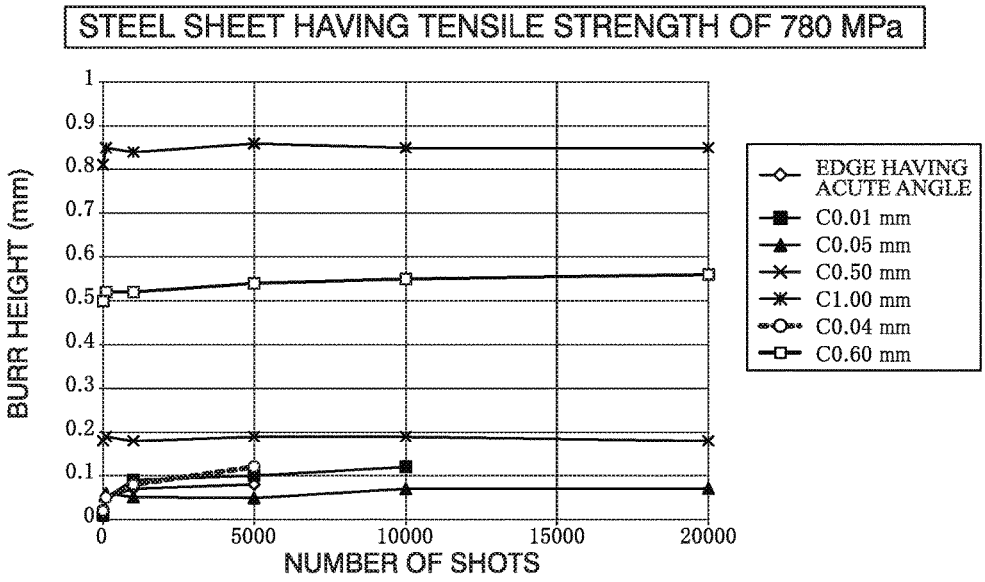
FIG. 9C is a graph showing transition of the height of the burr when the drilling is continuously performed on a workpiece consisting of a high-tension steel sheet having a tensile strength of 780 MPa according to the number of shots.

In FIGS. 9A to 9C, an aspect in which the burr height in the hole portion formed by the continuous drilling transits according to the number of shots is shown by graphs. FIG. 9A is a graph in a case where the mild steel sheet is the workpiece. FIG. 9B is a graph in a case where the steel sheet having a tensile strength of 590 MPa is the workpiece. FIG. 9C is a graph in a case where the high-tension steel sheet having a tensile strength of 780 MPa is the workpiece. In addition, among the workpieces, one that is considered as a target of the present invention is the high-tension steel sheet having a tensile strength of 780 MPa shown in FIG. 9C, and FIGS. 9A and 9B are shown as a reference.

As shown in FIGS. 9A and 9B, in a case where the mild steel sheet or the steel sheet having a tensile strength of 590 MPa is the workpiece, a case where the tool cutting edge has an acute angle or chamfered to have a chamfer dimension of C0.01 mm is excluded, and the burr height is equal to or greater than 0.2 mm through all of the number of shots.

Meanwhile, as shown in FIG. 9C, when the high-tension steel sheet having a tensile strength of 780 MPa is the workpiece, it was possible to suppress the burr height to be equal to or less than 0.2 mm in a case where the chamfer dimension of the tool cutting edge is equal to or less than C0.50 mm, but in a case where the chamfer of the tool cutting edge is equal to or greater than C0.60 mm, it was confirmed that the burr height suddenly increases.

More specifically, as shown in FIG. 9C, in a case of (13) and (14) in which the chamfer dimension is equal to or greater than C0.60 mm, the burr height is not limited to be within the allowable range, but in a case of (9) to (12) in which the chamfer dimension is equal to or less than C0.50 mm, it was confirmed that the burr height is limited to be within the allowable range.

Receiving the experiment result of FIG. 9C, an experiment that a tendency of the maximum value $\alpha$max of the chamfer dimension is obtained, was performed, when the high-tension steel or the ultra-high-tension steel having the tensile strength of equal to or greater than 780 MPa is used as the workpiece, and with respect to a case where the combination of the Vicker's hardness Hw of the same workpiece, the Vicker's hardness Ht of the tool, and the clearance c between the tools (between the punch and the die) is changed.

In other words, when the high-tension steel or the ultra-high-tension steel is used as the workpiece, after setting a plurality of combinations of the Vicker's hardness Hw of the same workpiece, the Vicker's hardness Ht of the tool, and the clearance c between the tools (between the punch and the die), the drilling was continuously performed by setting the upper limit to be 20000 shots with respect to each of the cases. In addition, under each setting condition, the maximum value of the chamfer dimension of the tool cutting edge of which the burr height is limited to be equal to or less than 0.2 mm, was obtained as the αmax. The result thereof is shown in the following Table 5.

[Table 5]

In addition, based on the experiment result of the above Table 5, the above-described αmax was obtained as the following (Equation 4) which is a function of the hardness ratio x and the clearance c between the tools.

$$\alpha max=(0.9+0.1e^{-0.07c})(-0.3274x^2+0.9768x-0.1457) \quad \text{(Equation 4)}$$

here, the unit of αmax is (mm), and the hardness ratio x or the clearance c is the same as that described in the above-described (Equation 3).

According to the above-described experiment result, when the high-tension steel or the ultra-high-tension steel having the tensile strength of equal to or greater than the 780 MPa is the workpiece, since the burr to be generated is fine to an allowable degree and a sudden deficiency of the tool cutting edge is not generated, the chamfer dimension of the tool cutting edge was required to be C0.05 mm to C0.5 mm. In addition, in a case where the target of the workpiece is in a wider range including the ultra-high-tension steel, by setting the chamfer dimension of the tool cutting edge to be within a range of the αmin to the αmax, it was required that the burr to be generated is fine to an allowable degree and a sudden deficiency of the tool cutting edge is not generated.

In addition, when a shearing sequence is started, as means for chamfering the tool cutting edge of both of the punch and the die to C0.05 mm to C0.5 mm or the min to the αmax, grinding or the like using the NC working machine is shown as an example.

Accordingly, in the manufacturing device of sheared components 100 which includes the punch 110 and the die 120, and which mass-produces the sheared components by continuously performing the shearing with respect to multiple high-tension steel sheets of which the maximum tensile strength is equal to or greater than 780 MPa grade and which are used as the workpiece 1, it is preferable that the tool cutting edges 113 and 123 of both of the punch 110 and the die 120, are chamfered to have C0.05 mm to C0.5 mm, when a shearing sequence is started. Furthermore, in a case where the target of the workpiece 1 is within a wider range than the range including the ultra-high-tension steel, it is preferable that the chamfer dimension of the tool cutting edges 113 and 123 is within a range of αmin to αmax.

According to the manufacturing device of sheared components, the shearing is continuously performed on the multiple steel sheets, such as the high-tension steel sheet having the maximum tensile strength of equal to or greater than 780 MPa grade, or the ultra-high-tension steel having the maximum tensile strength of equal to or greater than 780 MPa grade, which are used as the workpiece 1, the burr to be generated is fine to an allowable degree, a sudden deficiency of the tool cutting edges is not generated, and it is possible to mass-produce the sheared component.

Main points of the embodiment described above will be summarized hereinafter.

(A) In a manufacturing method and a manufacturing device of sheared components according to the embodiment, the method is a method for manufacturing a plurality of sheared components by performing a shearing a plurality of times by using a punch 110 and a die 120 with respect to a workpiece 1 of which the Vicker's hardness is equal to or greater than 0.3 times and less than 1.0 times the lower one of the Vicker's hardness of the punch 110 and the Vicker's hardness of the die 120, in which the shearing including a process of fixing the workpiece 1 to the die 120, and a process of punching the workpiece 1 by bringing the punch 110 and the die 120 relatively close to each other, is performed a plurality of times, and in which, when a shearing sequence is started, the shearing is performed by using a punch 110 including a first cutting edge 113 having a first tip end surface 111 which opposes the workpiece 1, and a first retracting surface 112 which retracts from the first tip end surface 111 considering the approaching direction to the die 120 as a standard; and a die 120 including a second cutting edge 123 having a second tip end surface 121 which opposes the workpiece 1, and a second retracting surface 122 which retracts from the second tip end surface 121 considering the approaching direction to the punch 110 as a standard.

(B) In the above-described (A), the first retracting surface 112 in a case of being viewed on the section perpendicular to the first tip end surface 111, may be a curved surface having a curvature that is equal to or greater than Rmin (mm) defined by the following Equation 1 and that is equal to or less than Rmax (mm) defined by the following Equation 2, or a chamfer having an inclination angle of 45° with respect to a tangent 1 of the first tip end surface 111, and having a width dimension that is equal to or greater than αmin (mm) defined by the following Equation 3 and that is equal to or less than αmax (mm) defined by the following Equation 4, and the second retracting surface 122 in a case of being viewed on the section perpendicular to the second tip end surface 121, may be a curved surface having a curvature that is equal to or greater than Rmin (mm) defined by the following Equation 1 and that is equal to or less than Rmax (mm) defined by the following Equation 2, or a chamfer having an inclination angle of 45° with respect to a tangent of the second tip end surface 121, and having a width dimension that is equal to or greater than αmin (mm) defined by the following Equation 3 and that is equal to or less than αmax (mm) defined by the following Equation 4.

$$Rmin=(0.9+0.2e^{-0.08c})(0.3571x^2-0.2595x+0.0965) \quad \text{(Equation 1)}$$

$$Rmax=(0.9+0.2e^{-0.08c})(-9.1856x^4+25.17x^3-24.95x^2+11.054x-1.5824) \quad \text{(Equation 2)}$$

$$\alpha min=0.0222e^{2.0833x}(0.9+0.1e^{-0.07c}) \quad \text{(Equation 3)}$$

$$\alpha max=(0.9+0.1e^{-0.07c})(-0.3274x^2+0.9768x-0.1457) \quad \text{(Equation 4)}$$

here, e is a base of a natural logarithms, c (mm) indicates a clearance between an inner surface of the die 120 and an outer surface of the punch 110, and x is a hardness ratio obtained by dividing the Vicker's hardness of the workpiece 1 by the Vicker's hardness of the punch 110 in the punch 110, is a hardness ratio obtained by dividing the Vicker's hardness of the workpiece 1 by the Vicker's hardness of the die 130 in the die 130, and satisfies $0.3 \leq x < 1.0$.

(C) In a case of the above-described (B), one or both of the first retracting surface 112 and the second retracting surface 122 may be a curved surface having curvature of 0.05 mm to 0.5 mm; or one or both of the first retracting surface 112 and the second retracting surface 122 may be a chamfer with a chamfer distance of C0.05 mm to C0.5 mm.

In addition, according to the method of the above-described (A) to (C), it is possible to manufacture the sheared components at a low cost without generation of a sudden deficiency of the cutting edge, even when the workpiece 1 which is made of the high-tension steel or the ultra-high-tension steel in which the Vicker's hardness thereof becomes equal to or greater than 0.3 times the Vicker's hardness of the tool is used.

In addition, as will be described hereinafter, even in a case where the tool cutting edge is rounded and in a case where the tool cutting edge is chamfered, it is preferable that any one of surface decarbonizing treatment, plating, and a specific lubricating treatment is performed with respect to the surface of the workpiece 1 before performing the shearing.

Figure 10:
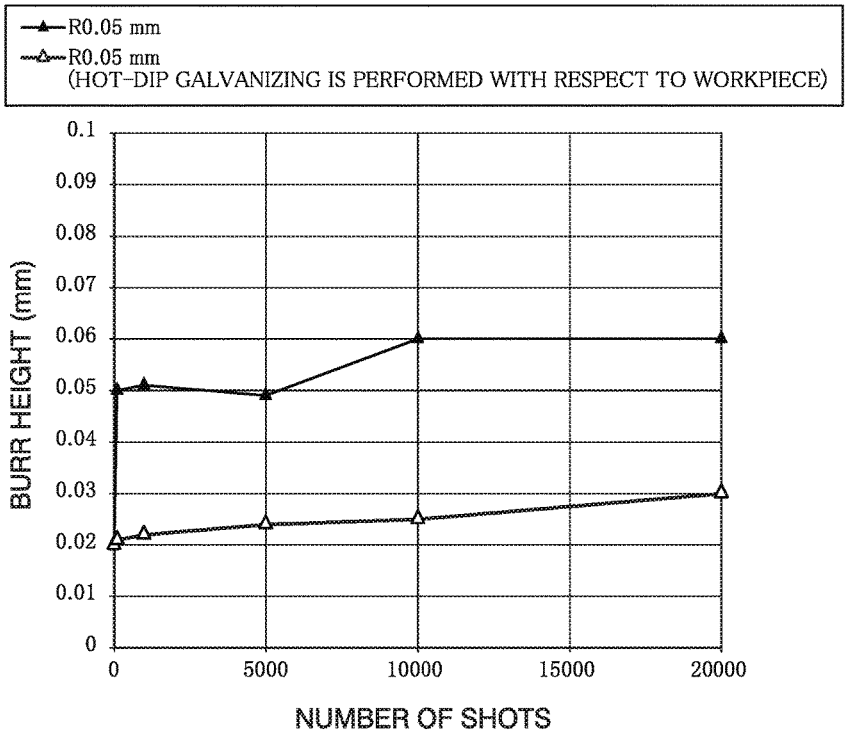
FIG. 10 is a graph showing an effect of reducing the height of the burr in a case where hot-dip galvanizing is performed as surface treatment with respect to the workpiece.

The inventors performed the investigation in steel sheets to which different surface treatments were performed. The experiment result thereof is shown in FIG. 10. FIG. 10 is a graph showing the transition of the burr height in the workpiece at each number of shots when the drilling is continuously performed in the workpiece by using a tool having the roundness in which the radius of curvature is 0.05 mm in the tool cutting edge. In addition, a case where a workpiece to which hot-dip galvanizing is performed is used as the workpiece, and a case where the workpiece which is not treated is used, are compared with each other. As is apparent from the comparison result, compared to a case where the workpiece which is not treated, it was confirmed that the burr height can be reduced in a case where the hot-dip galvanizing is performed with respect to the workpiece. When the hot-dip galvanizing is performed with respect to the workpiece, a hot-dip galvanized layer mitigates an impulsive force applied to the tool cutting edge, and as a result, it is possible to press wear (increase in the size of the curvature of the roundness) of the tool cutting edge, and thus, it was considered that an increase in the burr height is suppressed.

As described above, for example, if the hot-dip galvanizing is performed with respect to the surface of the workpiece, compared to a case where the workpiece which is not treated, a result that the burr height is further suppressed is obtained. In addition, the surface treatment is not limited only to the hot-dip galvanizing.

In addition, in any of a case where the tool cutting edge is rounded and a case where the tool cutting edge is chamfered, in any of the punch and the die, it is also not necessary to round or chamfer the entire tool cutting edge, and when a part at which there is a concern that a sudden deficiency is generated is confirmed in advance by experience or the like, only the cutting edge of the part may be rounded or chamfered.

Furthermore, by relatively increasing a coefficient of friction of other parts compared to a tool side surface, it is possible to further suppress the plastic flow of a material which abuts against the other parts when shearing the workpiece, and accordingly, it is possible to further reduce the burr height.

Figure 11:
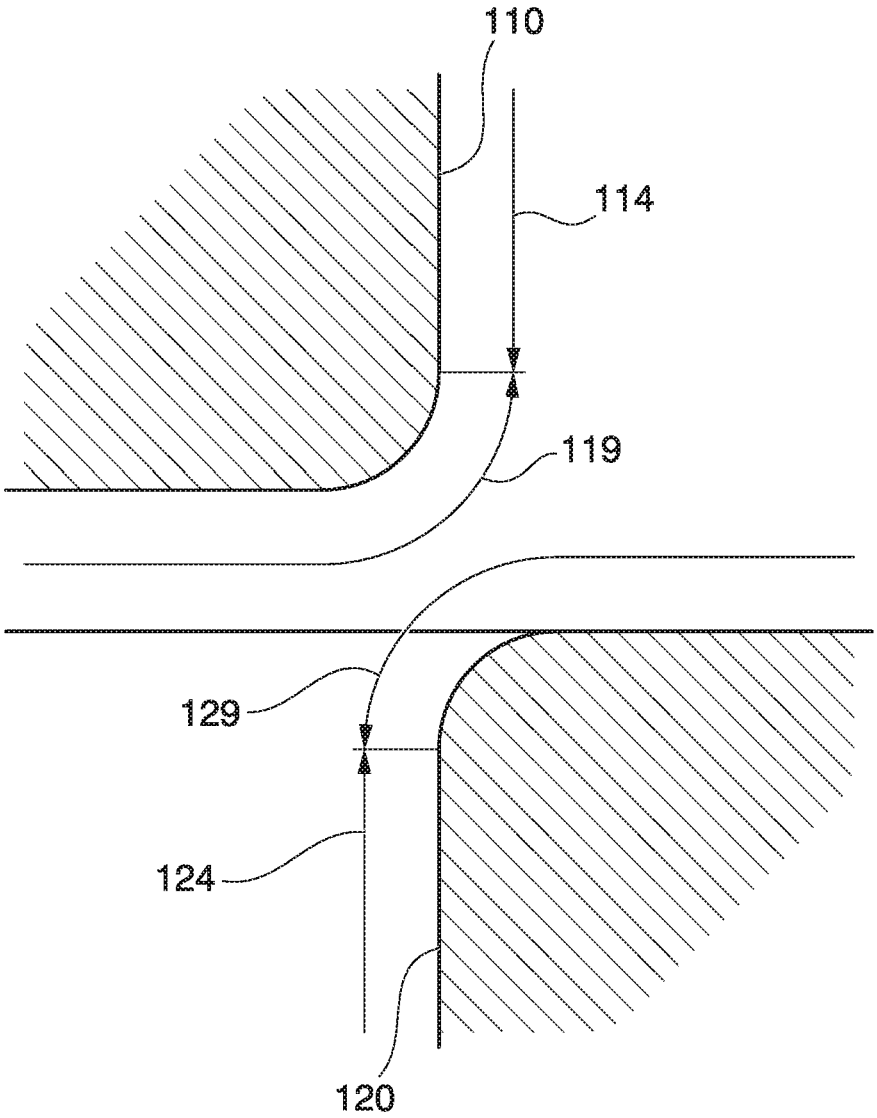
FIG. 11 is a view showing a modification example of the embodiment, and is a sectional view in which a tool cutting edge part is enlarged in a case where divisional polishing is performed with respect to each of the punch and the die.

FIG. 11 is a sectional view showing tool cutting edges of each of the punch 110 and the die 120 are enlarged in the manufacturing device of sheared components according to the embodiment.

As means for relatively increasing the coefficient of friction of the part other than the tool side surface, for example, an example in which polishing of the tool is performed only to the outer surface 114 and the through hole 124 (hereinafter, also referred to as the inner surface 124) of each of the punch 110 and the die 120 (hereinafter, referred to as "divisional polishing"), is shown. When the divisional polishing is used, for example, it is possible to set the coefficient of friction of parts 119 and 129 other than the outer surface 114 and the inner surface 124 to be 0.2, and the coefficient of friction of the outer surface 114 and the inner surface 124 to be 0.1. As a result, it is possible to further reduce the burr height.

As another means for relatively increasing the coefficient of friction of the parts 119 and 129 other than the outer surface 114 and the inner surface 124, for example, a method for making the punch 110 and the die 120 by soft tool steel in advance, and performing nitriding or coating treatment only to the outer surface 114 of the punch 110 also can be used. In addition, by the coating for increasing the coefficient of friction or the surface treatment to provide fine unevenness, it is possible to relatively increase the coefficient of friction of the parts 119 and 129 other than the outer surface 114 and the inner surface 124.

The coefficient of friction is measured by a test (in general, a test which is used as a measuring method of the coefficient of friction) of pressing and sliding the tool on the steel sheet which becomes the workpiece 1. The value is defined as a value obtained by dividing sliding friction by a pushing pressure. In addition, as a sample material of the sliding test, it is possible to use the tool itself which is supposed to slide when the shearing is performed, or a part of the tool by cutting out the part so that an area of a contact portion becomes equal to or greater than 1.0 $mm^2$. It is desirable that the pushing pressure when performing the sliding test is approximately 50 MPa to 300 MPa and a sliding speed is approximately 10 mm/second to 400 mm/second.

Materials of the punch 110 and the die 120 can be well-known or commonly used tool steel as the type of tool steel. For example, it is desirable to use high speed steel, such as SKH51, die steel, such as SKD11, or super-steel which is approximately V40.

The tool durability test for verifying the rear retracting surface or an effect of the divisional polishing of the present invention was performed by considering the drilling of a hole having a diameter of 10 mm as a target. When the high-tension steel sheet having a tensile strength of 780 MPa is used as the workpiece, and the clearance c between the punch 110 and the die 120 is set to be 15% t (% t indicates a proportion of the clearance width with respect to the sheet thickness of the workpiece. In this example, when the sheet thickness of the workpiece is t (mm), the clearance becomes 0.15×t (mm)), the drilling was continuously performed to the maximum 20000 shots.

When continuously performing the drilling, a shape of the cutting edges of both of the punch 110 and the die 120 is set to be in three cases, such as an acute angle, R0.5 mm, and C0.5 mm, and further regarding the R0.5 mm and C0.5 mm, two types of tools of a condition in which the polishing is performed with respect to the entire surface of the tool and a condition in which the polishing is performed only with respect to the side surface of the tool.

At this time, the coefficient of friction measured by the sliding test becomes approximately 0.1 at a part to which the polishing is performed, and becomes 0.25 at a part to which the polishing is not performed.

Figure 12:
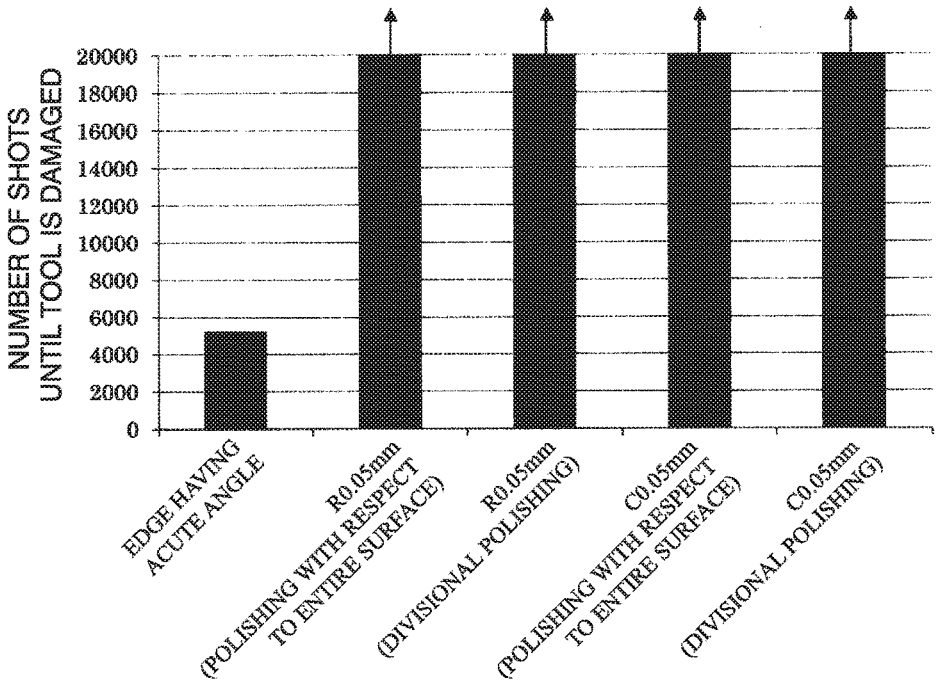
FIG. 12 is a bar graph showing the number of shots when the drilling is continuously performed until the tool cutting edge is damaged. The horizontal axis indicates a radius of curvature of the roundness of the tool cutting edge or a chamfering dimension of the tool cutting edge, and the vertical axis indicates the number of shots until the tool is damaged.

FIG. 12 is a bar graph showing the number of shots until the tool is damaged.

As shown in FIG. 12, tool damage was generated in a case where the tool cutting edge has an acute angle, but the tool damage was not generated under a condition of R0.05 mm and C0.05 mm which is an example of the present invention regardless of the polished state of the tool.

Figure 13:
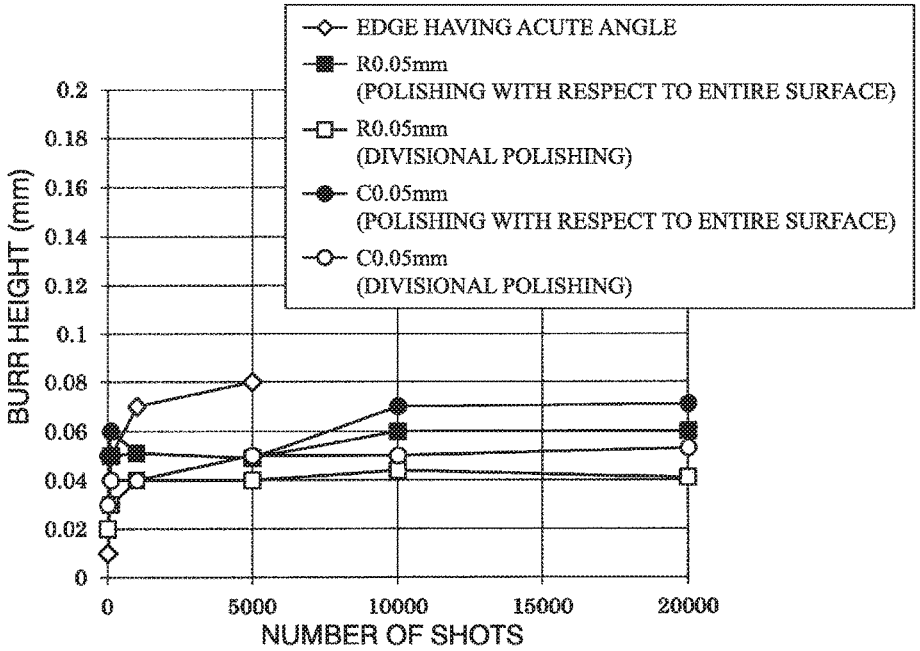
FIG. 13 is a graph showing transition of the height of the burr when the drilling is continuously performed according to the number of shots.

In FIG. 13, the transition of the burr height according to the number of shots in the hole portion after the drilling is shown as a graph.

As shown in FIG. 13, the burr height is also equal to or less than 0.2 mm in any tool, but in a case where the divisional polishing for polishing only the side surface is performed, the burr height is further apparently lower than that in a case of a tool of which the entire surface is polished.

In the above-described divisional polishing, the surface of the tool is divided into two including a side surface part and other parts. However, more preferably, it is desirable that at least one of a first condition in which a frictional resistance of the first retracting surface 112 is the highest among the first tip end surface 111 of the punch 110 which opposes the workpiece 1, the first retracting surface 112 of the punch 110 (rounded R portion) including the tool cutting edge 113, and the outer surface 114 of the punch 110; or a second condition in which a frictional resistance of the second retracting surface 122 is the highest among the second tip end surface 121 of the die 120 which opposes the workpiece 1, the second retracting surface 122 of the die 120 (rounded R portion) including the tool cutting edge 123, and the inner surface 124 of the die 120, is satisfied.

In addition, it is preferable that both of the above-described first condition and the second condition are satisfied. Furthermore, in other words, it is most preferable that the frictional resistance is high in an order of the first retracting surface 112 (rounded R portion), then, the first tip end surface 111, and further, the outer surface 114; and additionally, the fictional resistance is high in an order of the second retracting surface 122 (rounded R portion), then, the second tip end surface 121, and further, the inner surface 124.

By employing the frictional resistance difference, it is possible to improve the cutting quality in both of the first retracting surface 112 of the punch 110 and the second retracting surface 122 of the die 120, and it is possible to further suppress the burr height in the workpiece 1 to be lower. In order to confirm the effect, an experiment was performed by providing the frictional resistance difference between each of a tool tip end surface, a tool cutting edge R portion, and a tool side surface, with respect to a tool of which the tool cutting edge is rounded. During the experiment, by setting the clearance between the punch 110 and the die 120 to be 15% t (when the sheet thickness of the workpiece is t (mm), the clearance becomes 0.15×t (mm)), the drilling was continuously performed to the maximum 10000 shots. The experiment result is shown in the following Table 6.

[Table 6]

As shown, for example, in the number 105 of the above Table 6, when the frictional resistances are aligned in an order of size, in a case where an order of the tool cutting edge R portion, the tip end surface, and the side surface was achieved, it was confirmed that the burr height is limited 0.04 mm.

The above-described Table 6 is the experiment result showing a case where the tool cutting edge is rounded, but the result is also similar in a case where the tool cutting edge is chamfered.

In other words, it is desirable that at least one of a third condition in which a frictional resistance of the first retracting surface 112 of the punch is the highest among the first tip end surface 111 of the punch which opposes the workpiece 1, the first retracting surface 112 of the punch which has a chamfer portion, and the outer surface 114 of the punch 110; or a fourth condition in which a frictional resistance of the second retracting surface 122 of the die 120 is the highest among the second tip end surface 121 of the die 120 which opposes the workpiece 1, the second retracting surface 122 of the die 120 which has a chamfer portion, and the inner surface 124 of the die 120, is satisfied.

In addition, it is preferable that both of the above-described third condition and the fourth condition are satisfied. Furthermore, in other words, it is most preferable that the frictional resistance is high in an order of the first retracting surface 112, then, the first tip end surface 111, and further, the outer surface 114; and additionally, the fictional resistance is high in an order of the second retracting surface 122, then, the second tip end surface 121, and further, the inner surface 124.

Even in a case of the chamfer, by employing the frictional resistance difference, it is possible to improve the cutting quality in both of the first retracting surface 112 of the punch 110 and the second retracting surface 122 of the die 120, and it is possible to further suppress the burr height in the workpiece 1 to be lower. In order to confirm the effect, an experiment was performed by providing the frictional resistance difference between each of the tool tip end surface, a tool cutting edge chamfer portion, and the tool side surface, with respect to a tool of which the tool cutting edge is chamfered. During the experiment, by setting the clearance between the punch 110 and the die 120 to be 15% t (when the sheet thickness of the workpiece is t (mm), the clearance becomes 0.15×t (mm)), the drilling was continuously performed to the maximum 10000 shots. The experiment result is shown in the following Table 7.

[Table 7]

As shown, for example, in the number 122 of the above Table 7, when the frictional resistances are aligned in an order of size, in a case where an order of the chamfer portion, the tip end surface, and the side surface was achieved, it was confirmed that the burr height is limited to 0.04 mm.

As described above, the above-described (A) to (C) are employed as the shape of the tool cutting edge, and additionally, the following (D) may also be further employed.

(D) In the aspect described in any one of the above-described (A) to (C), at least one of a first condition in which a frictional resistance of the first retracting surface 112 is the highest among the first tip end surface 111 of the punch 110, the first retracting surface 112 of the punch 110, and the outer surface 114 of the punch 110, or a second condition in which a frictional resistance of the second retracting surface 122 is the highest among the second tip end surface 121 of the die 120, the second retracting surface 122 of the die 120, and the inner surface 124 of the die 120, is satisfied.

Furthermore, the following (E) may be employed. In this case, as described above, compared to a case where the workpiece is not treated, it is possible to further extend the tool service life.

(E) In the aspect described in any one of the above-described (A) to (D), any one of surface decarbonizing treatment, plating, and a specific lubricating treatment is performed with respect to the workpiece 1 in advance.

In addition, not being limited to a configuration in which both of the tool cutting edge 113 of the punch 110 and the tool cutting edge 123 of the die 120 are rounded, or a configuration in which both the tool cutting edge 113 of the punch 110 and the tool cutting edge 123 of the die 120 are chamfered, for example, a configuration in which the tool cutting edge of the punch 110 is rounded and the tool cutting edge of the die 120 is chamfered, or a configuration in which the tool cutting edge of the punch 110 is chamfered and the tool cutting edge of the die 120 is rounded, may be employed.

Figure 14:
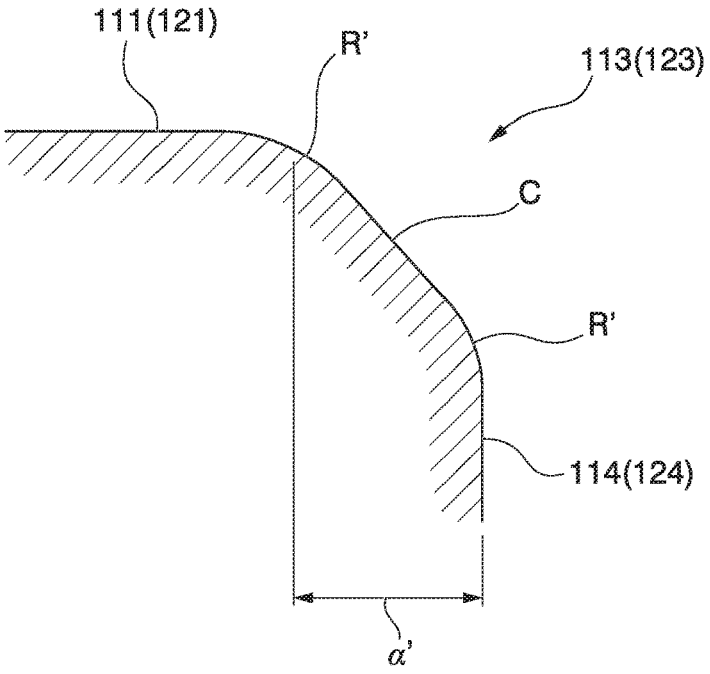
FIG. 14 is a view showing another modification example of the tool, and is a sectional view of the tool cutting edge part in a case of being viewed on the section perpendicular to a tip end surface of the tool.
Figure 15:
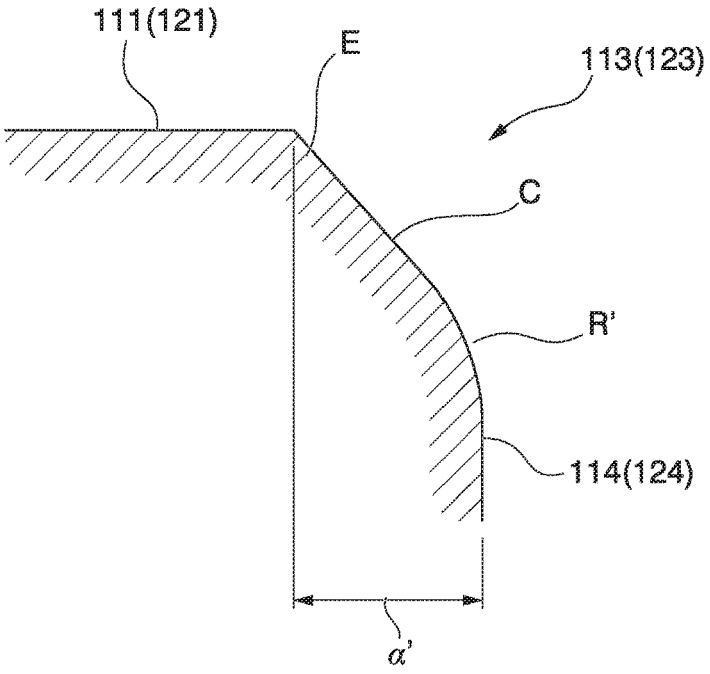
FIG. 15 is a view showing still another modification example of the tool, and is a sectional view of the tool cutting edge part in a case of being viewed on the section perpendicular to the tip end surface of the tool.
Figure 16A:
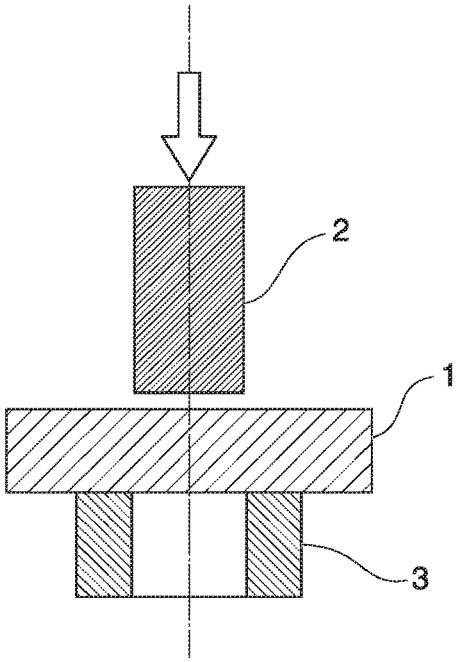
FIG. 16A is a view schematically showing the drilling for forming a hole by shearing the workpiece, and is a longitudinal sectional view in a case of being viewed on the section including an axial line of the punch.
Figure 16B:
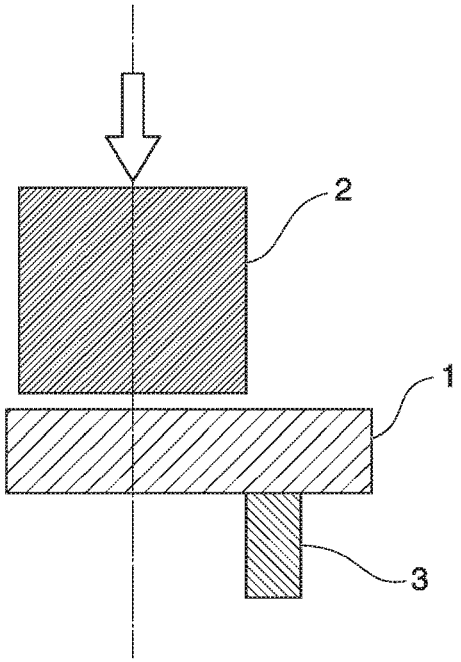
FIG. 16B is a view schematically showing cutting for forming an open section by shearing the workpiece, and is a longitudinal sectional view in a case of being viewed on the section of the workpiece in the thickness direction.
Figure 17:
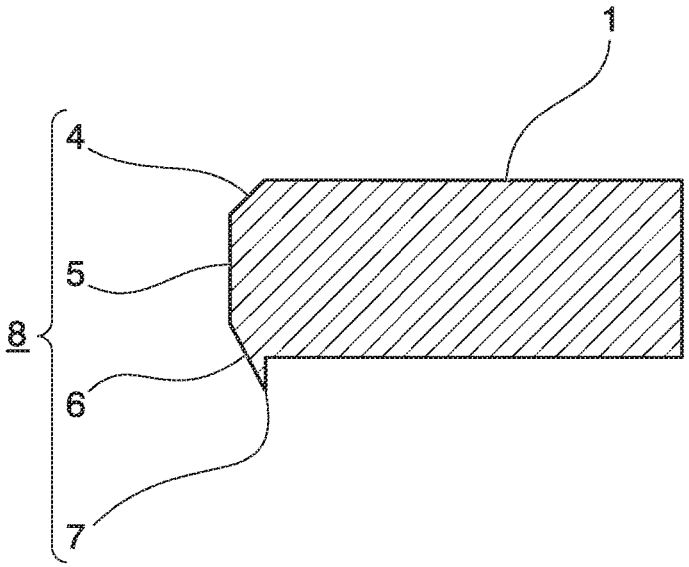
FIG. 17 is a view showing a sheared surface of the workpiece formed by the shearing, and is a sectional view in a case of being viewed on the section perpendicular to a surface of the workpiece.

In addition, as a shape of the tool cutting edge of the punch 110 and the tool cutting edge of the die 120, not being limited only to the above-described embodiment, for example, modification examples which are shown in FIGS. 14 and 15 can be employed.

In other words, in the modification example of FIG. 14, the chamfer C is formed in the tool cutting edge 113 (123), and a roundness R' is provided both between the chamfer C and the tool tip end surface 111 (121), and between the chamfer C and the tool side surface 114 (124). Accordingly, the surface is smoothly formed without an angle portion from the tool tip end surface 111 (121) to the tool side surface 114 (124) via the chamfer C. In addition, a curvature of the above-described two roundnesses R' may be the same as each other, or may be different from each other.

In addition, as a width dimension α' of the chamfer, it is preferable to satisfy $\alpha min<\alpha'<\alpha max$ based on the above-described (Equation 3) and (Equation 4).

In addition, in the above-described modification example of FIG. 14, the roundnesses R' are provided on both sides of the chamfer C, but for example, as shown in the modification example of FIG. 15, the roundness R' may be provided only between the chamfer C and the tool side surface 114 (124). In this case, it is preferable that the chamfer C is formed in the tool cutting edge 113 (123), an angle E is provided between the chamfer C and the tool tip end surface 111 (121), and the roundness R' is provided between the chamfer C and the tool side surface 114 (124).

In addition, as the width dimension α' of the chamfer, it is preferable to satisfy $\alpha min<\alpha'<\alpha max$ based on the above-described (Equation 3) and (Equation 4).

Furthermore, contrary to the modification example of FIG. 15, the roundness R' may be provided only between the chamfer C and the tool tip end surface 111 (121) (the figure was omitted). In this case, it is preferable that the chamfer C is formed in the tool cutting edge 113 (123), the roundness R' is provided between the chamfer C and the tool tip end surface 111 (121), and the angle E is provided between the chamfer C and the tool side surface 111 (121).

INDUSTRIAL APPLICABILITY

According to the present invention, it is possible to manufacture the sheared components at a low cost without generation of a sudden deficiency of a cutting edge, even when a workpiece which is made of high-tension steel or ultra-high-tension steel in which the Vicker's hardness thereof becomes equal to or greater than 0.3 times the Vicker's hardness of a tool is used.

BRIEF DESCRIPTION OF THE REFERENCE SYMBOLS

1: WORKPIECE
110: PUNCH
111: FIRST TIP END SURFACE
112: FIRST RETRACTING SURFACE
113: FIRST CUTTING EDGE
120: DIE
121: SECOND TIP END SURFACE
122: SECOND RETRACTING SURFACE
123: SECOND CUTTING EDGE

TABLE 1

| Case | Vicker's hardness of tool Ht (MPa) | Vicker's hardness of steel sheet Hw (MPa) | Hardness ratio x = Hw/Ht | Clearance c considering steel sheet thickness t as standard | State of tool cutting edge after 10000 shots | Tool evaluation (*) |
|---|---|---|---|---|---|---|
| a | 800 | 80 | 0.1 | 10% t | not damaged | G |
| b | 800 | 80 | 0.1 | 15% t | not damaged | G |
| c | 1000 | 100 | 0.1 | 20% t | not damaged | G |
| d | 800 | 160 | 0.2 | 10% t | not damaged | G |
| e | 800 | 160 | 0.2 | 15% t | not damaged | G |
| f | 1000 | 200 | 0.2 | 20% t | not damaged | G |
| g | 800 | 240 | 0.3 | 10% t | surface is damaged | NG |
| h | 800 | 240 | 0.3 | 15% t | surface is damaged | NG |
| i | 1000 | 300 | 0.3 | 20% t | surface is damaged | NG |
| j | 800 | 320 | 0.4 | 10% t | deficiency is present | NG |
| k | 800 | 320 | 0.4 | 15% t | deficiency is present | NG |
| l | 1000 | 400 | 0.4 | 20% t | deficiency is present | NG |
| m | 800 | 400 | 0.5 | 10% t | large deficiency | NG |
| n | 800 | 400 | 0.5 | 15% t | large deficiency | NG |
| o | 1000 | 500 | 0.5 | 20% t | large deficiency | NG |

(*) G: Good
NG: Not Good

TABLE 2

| Number | Vicker's hardness of tool Ht (MPa) | Vicker's hardness of steel sheet Hw (MPa) | Hardness ratio x = Hw/Ht | Clearance c (mm) | Tool cutting edge Rmin (mm) |
|---|---|---|---|---|---|
| 1 | 865 | 260 | 0.301 | 10 | 0.050 |
| 2 | 865 | 500 | 0.578 | 10 | 0.065 |
| 3 | 865 | 700 | 0.809 | 10 | 0.120 |
| 4 | 865 | 865 | 1.000 | 10 | 0.190 |
| 5 | 1000 | 300 | 0.300 | 10 | 0.050 |
| 6 | 1000 | 500 | 0.500 | 10 | 0.055 |
| 7 | 1000 | 700 | 0.700 | 10 | 0.089 |
| 8 | 1000 | 865 | 0.865 | 10 | 0.140 |
| 9 | 865 | 260 | 0.301 | 5 | 0.052 |
| 10 | 865 | 500 | 0.578 | 5 | 0.068 |
| 11 | 865 | 700 | 0.809 | 5 | 0.120 |
| 12 | 865 | 865 | 1.000 | 5 | 0.200 |
| 13 | 1000 | 300 | 0.300 | 5 | 0.053 |
| 14 | 1000 | 500 | 0.500 | 5 | 0.058 |
| 15 | 1000 | 700 | 0.700 | 5 | 0.093 |
| 16 | 1000 | 865 | 0.865 | 5 | 0.140 |
| 17 | 865 | 260 | 0.301 | 15 | 0.049 |
| 18 | 865 | 500 | 0.578 | 15 | 0.063 |
| 19 | 865 | 700 | 0.809 | 15 | 0.120 |

TABLE 2-continued

| Number | Vicker's hardness of tool Ht (MPa) | Vicker's hardness of steel sheet Hw (MPa) | Hardness ratio x = Hw/Ht | Clearance c (mm) | Tool cutting edge Rmin (mm) |
|---|---|---|---|---|---|
| 20 | 865 | 865 | 1.000 | 15 | 0.190 |
| 21 | 1000 | 300 | 0.300 | 15 | 0.049 |
| 22 | 1000 | 500 | 0.500 | 15 | 0.054 |
| 23 | 1000 | 700 | 0.700 | 15 | 0.086 |
| 24 | 1000 | 865 | 0.865 | 15 | 0.130 |

TABLE 3

| Number | Vicker's hardness of tool Ht (MPa) | Vicker's hardness of steel sheet Hw (MPa) | Hardness ratio x = Hw/Ht | Clearance c (mm) | Tool cutting edge Rmin (mm) |
|---|---|---|---|---|---|
| 25 | 865 | 260 | 0.301 | 10 | 0.095 |
| 26 | 865 | 500 | 0.578 | 10 | 0.300 |
| 27 | 865 | 700 | 0.809 | 10 | 0.420 |
| 28 | 865 | 865 | 1.000 | 10 | 0.500 |
| 29 | 1000 | 300 | 0.300 | 10 | 0.092 |
| 30 | 1000 | 500 | 0.500 | 10 | 0.280 |
| 31 | 1000 | 700 | 0.700 | 10 | 0.350 |
| 32 | 1000 | 865 | 0.865 | 10 | 0.450 |
| 33 | 865 | 260 | 0.301 | 5 | 0.098 |
| 34 | 865 | 500 | 0.578 | 5 | 0.320 |
| 35 | 865 | 700 | 0.809 | 5 | 0.440 |
| 36 | 865 | 865 | 1.000 | 5 | 0.520 |
| 37 | 1000 | 300 | 0.300 | 5 | 0.097 |
| 38 | 1000 | 500 | 0.500 | 5 | 0.290 |
| 39 | 1000 | 700 | 0.700 | 5 | 0.370 |
| 40 | 1000 | 865 | 0.865 | 5 | 0.480 |
| 41 | 865 | 260 | 0.301 | 15 | 0.091 |
| 42 | 865 | 500 | 0.578 | 15 | 0.290 |
| 43 | 865 | 700 | 0.809 | 15 | 0.410 |
| 44 | 865 | 865 | 1.000 | 15 | 0.490 |
| 45 | 1000 | 300 | 0.300 | 15 | 0.090 |
| 46 | 1000 | 500 | 0.500 | 15 | 0.270 |
| 47 | 1000 | 700 | 0.700 | 15 | 0.340 |
| 48 | 1000 | 865 | 0.865 | 15 | 0.440 |

TABLE 4

| Number | Vicker's hardness of tool Ht (MPa) | Vicker's hardness of steel sheet Hw (MPa) | Hardness ratio x = Hw/Ht | Clearance c (mm) | Chamfer width αmin (mm) | θ (deg) |
|---|---|---|---|---|---|---|
| 49 | 865 | 260 | 0.301 | 10 | 0.04 | 45 |
| 50 | 865 | 500 | 0.578 | 10 | 0.07 | 45 |
| 51 | 865 | 700 | 0.809 | 10 | 0.12 | 45 |
| 52 | 865 | 865 | 1.000 | 10 | 0.18 | 45 |
| 53 | 1000 | 300 | 0.300 | 10 | 0.04 | 45 |
| 54 | 1000 | 500 | 0.500 | 10 | 0.06 | 45 |
| 55 | 1000 | 700 | 0.700 | 10 | 0.10 | 45 |
| 56 | 1000 | 865 | 0.865 | 10 | 0.14 | 45 |
| 57 | 865 | 260 | 0.301 | 5 | 0.04 | 45 |
| 58 | 865 | 500 | 0.578 | 5 | 0.07 | 45 |
| 59 | 865 | 700 | 0.809 | 5 | 0.12 | 45 |
| 60 | 865 | 865 | 1.000 | 5 | 0.18 | 45 |
| 61 | 1000 | 300 | 0.300 | 5 | 0.04 | 45 |
| 62 | 1000 | 500 | 0.500 | 5 | 0.06 | 45 |
| 63 | 1000 | 700 | 0.700 | 5 | 0.10 | 45 |
| 64 | 1000 | 865 | 0.865 | 5 | 0.14 | 45 |
| 65 | 865 | 260 | 0.301 | 15 | 0.04 | 45 |
| 66 | 865 | 500 | 0.578 | 15 | 0.07 | 45 |
| 67 | 865 | 700 | 0.809 | 15 | 0.12 | 45 |
| 68 | 865 | 865 | 1.000 | 15 | 0.18 | 45 |
| 69 | 1000 | 300 | 0.300 | 15 | 0.04 | 45 |
| 70 | 1000 | 500 | 0.500 | 15 | 0.06 | 45 |

TABLE 4-continued

| Number | Vicker's hardness of tool Ht (MPa) | Vicker's hardness of steel sheet Hw (MPa) | Hardness ratio x = Hw/Ht | Clearance c (mm) | Chamfer width αmin (mm) | θ (deg) |
|---|---|---|---|---|---|---|
| 71 | 1000 | 700 | 0.700 | 15 | 0.10 | 45 |
| 72 | 1000 | 865 | 0.365 | 15 | 0.14 | 45 |

TABLE 5

| Number | Vicker's hardness of tool Ht (MPa) | Vicker's hardness of steel sheet Hw (MPa) | Hardness ratio x = Hw/Ht | Clearance c (mm) | Chamfer width αmin (mm) | θ (deg) |
|---|---|---|---|---|---|---|
| 73 | 865 | 260 | 0.301 | 10 | 0.11 | 45 |
| 74 | 865 | 500 | 0.578 | 10 | 0.29 | 45 |
| 75 | 865 | 700 | 0.809 | 10 | 0.41 | 45 |
| 76 | 865 | 865 | 1.000 | 10 | 0.48 | 45 |
| 77 | 1000 | 300 | 0.300 | 10 | 0.11 | 45 |
| 78 | 1000 | 500 | 0.500 | 10 | 0.25 | 45 |
| 79 | 1000 | 700 | 0.700 | 10 | 0.36 | 45 |
| 80 | 1000 | 865 | 0.865 | 10 | 0.43 | 45 |
| 81 | 865 | 260 | 0.301 | 5 | 0.11 | 45 |
| 82 | 865 | 500 | 0.578 | 5 | 0.30 | 45 |
| 83 | 865 | 700 | 0.809 | 5 | 0.42 | 45 |
| 84 | 865 | 865 | 1.000 | 5 | 0.49 | 45 |
| 85 | 1000 | 300 | 0.300 | 5 | 0.11 | 45 |
| 86 | 1000 | 500 | 0.500 | 5 | 0.25 | 45 |
| 87 | 1000 | 700 | 0.700 | 5 | 0.37 | 45 |
| 88 | 1000 | 865 | 0.865 | 5 | 0.44 | 45 |
| 89 | 865 | 260 | 0.301 | 15 | 0.11 | 45 |
| 90 | 865 | 500 | 0.578 | 15 | 0.29 | 45 |
| 91 | 865 | 700 | 0.809 | 15 | 0.40 | 45 |
| 92 | 865 | 865 | 1.000 | 15 | 0.47 | 45 |
| 93 | 1000 | 300 | 0.300 | 15 | 0.11 | 45 |
| 94 | 1000 | 500 | 0.500 | 15 | 0.24 | 45 |
| 95 | 1000 | 700 | 0.700 | 15 | 0.35 | 45 |
| 96 | 1000 | 865 | 0.865 | 15 | 0.42 | 45 |

TABLE 6

| | Frictional resistance of each part when frictional resistance of tip end surface is set to 1.0 | | | Radius of curvature of tool | Burr height | |
|---|---|---|---|---|---|---|
| Number | Tip end surface | Tool cutting edge R part | Side surface | cutting edge R part (mm) | after 10000 shots (mm) | Evaluation (*) |
| 97 | 1.0 | 1.0 | 1.0 | 0.05 | 0.06 | G |
| 98 | 1.0 | 1.0 | 1.0 | 0.30 | 0.14 | G |
| 99 | 1.0 | 1.0 | 1.0 | 0.50 | 0.19 | G |
| 100 | 1.0 | 0.9 | 1.0 | 0.05 | 0.085 | VG |
| 101 | 1.0 | 0.9 | 1.0 | 0.30 | 0.2 | VG |
| 102 | 1.0 | 0.9 | 1.0 | 0.50 | 0.28 | VG |
| 103 | 1.0 | 1.0 | 0.9 | 0.30 | 0.15 | VG |
| 104 | 1.0 | 1.0 | 0.9 | 0.50 | 0.19 | VG |
| 105 | 1.0 | 1.1 | 0.9 | 0.05 | 0.04 | VG |
| 106 | 1.0 | 1.1 | 0.9 | 0.30 | 0.1 | VG |
| 107 | 1.0 | 1.1 | 0.9 | 0.50 | 0.12 | VG |
| 108 | 1.0 | 1.1 | 0.9 | 0.05 | 0.06 | VG |
| 109 | 1.0 | 1.1 | 0.9 | 0.30 | 0.13 | VG |
| 110 | 1.0 | 1.1 | 0.9 | 0.50 | 0.18 | VG |
| 111 | 1.0 | 1.1 | 1.1 | 0.05 | 0.04 | G |
| 112 | 1.0 | 1.1 | 1.1 | 0.30 | 0.11 | G |
| 113 | 1.0 | 1.1 | 1.1 | 0.50 | 0.13 | G |

(*) VG: Very Good
G: Good

TABLE 7

| Number | Frictional resistance of each part when frictional resistance of tip end surface is set to 1.0 | | | Width dimension of tool | Burr | |
|---|---|---|---|---|---|---|
| | Tip end surface | Tool cutting edge chamfer part | Side surface | cutting edge chamfer part α (mm) | height after 10000 shots (mm) | Evaluation (*) |
| 114 | 1.0 | 1.0 | 1.0 | 0.05 | 0.07 | G |
| 115 | 1.0 | 1.0 | 1.0 | 0.30 | 0.17 | G |
| 116 | 1.0 | 1.0 | 1.0 | 0.50 | 0.19 | G |
| 117 | 1.0 | 0.9 | 1.0 | 0.05 | 0.09 | VG |
| 118 | 1.0 | 0.9 | 1.0 | 0.30 | 0.20 | VG |
| 119 | 1.0 | 0.9 | 1.0 | 0.50 | 0.22 | VG |
| 120 | 1.0 | 1.0 | 0.9 | 0.30 | 0.17 | VG |
| 121 | 1.0 | 1.0 | 0.9 | 0.50 | 0.19 | VG |
| 122 | 1.0 | 1.1 | 0.9 | 0.05 | 0.04 | VG |
| 123 | 1.0 | 1.1 | 0.9 | 0.30 | 0.12 | VG |
| 124 | 1.0 | 1.1 | 0.9 | 0.50 | 0.12 | VG |
| 125 | 1.0 | 1.1 | 0.9 | 0.05 | 0.06 | VG |
| 126 | 1.0 | 1.1 | 0.9 | 0.30 | 0.16 | VG |
| 127 | 1.0 | 1.1 | 0.9 | 0.50 | 0.18 | VG |
| 128 | 1.0 | 1.1 | 1.1 | 0.05 | 0.04 | G |
| 129 | 1.0 | 1.1 | 1.1 | 0.30 | 0.13 | G |
| 130 | 1.0 | 1.1 | 1.1 | 0.50 | 0.14 | G |

(*) VG: Very Good
G: Good

What is claimed is:

1. A method of manufacturing a plurality of sheared components by performing a shearing a plurality of times by using a punch and a die with respect to a workpiece of which a Vicker's hardness is equal to or greater than 0.3 times and less than 1.0 times the lower one of the Vicker's hardness of the punch and the Vicker's hardness of the die, the method comprising:

fixing the workpiece to the die, and performing a shearing process a plurality of times, wherein the shearing process includes punching the workpiece by bringing the punch and the die relatively close to each other a plurality of times to produce a sheared component, wherein, the punch includes a first tip end surface which opposes the workpiece, and a first cutting edge having a first retracting surface which retracts from the first tip end surface considering an approaching direction to the die as a standard; and the die includes a second tip end surface which opposes the workpiece, and a second cutting edge having a second retracting surface which retracts from the second tip end surface considering an approaching direction to the punch as a standard, wherein the first retracting surface in a case of being viewed on a section perpendicular to the first tip end surface, is a curved surface having a curvature that is equal to or greater than Rmin (mm) defined by a following Equation 1 and that is equal to or less than Rmax (mm) defined by a following Equation 2, or a chamfer having an inclination angle of 45° with respect to a tangent of the first tip end surface, and having a width dimension that is equal to or greater than αmin (mm) defined by a following Equation 3 and that is equal to or less than αmax (mm) defined by a following Equation 4, and wherein the second retracting surface in a case of being viewed on a section perpendicular to the second tip end surface, is a curved surface having a curvature that is equal to or greater than Rmin (mm) defined by the following Equation 1 and that is equal to or less than Rmax (mm) defined by the following Equation 2, or a chamfer having an inclination angle of 45° with respect to a tangent of the second tip end surface, and having a width dimension that is equal to or greater than αmin (mm) defined by the following Equation 3 and that is equal to or less than αmax (mm) defined by the following Equation 4

$$R\text{min}=(0.9+0.2e^{-0.08c})(0.3571x^2-0.2595x+0.0965) \quad \text{(Equation 1)}$$

$$R\text{max}=(0.9+0.2e^{-0.08c})(-9.1856x^4+25.17x^3-24.95x^2+11.054x-1.5824) \quad \text{(Equation 2)}$$

$$\alpha\text{min}=0.0222e^{2.0833x}(0.9+0.1e^{-0.07c}) \quad \text{(Equation 3)}$$

$$\alpha\text{max}=(0.9+0.1e^{-0.07c})(-0.3274x^2+0.9768x-0.1457) \quad \text{(Equation 4)}$$

here, e is a base of a natural logarithms, c (mm) indicates a clearance between an inner surface of the die and an outer surface of the punch, and x of the punch is a hardness ratio obtained by dividing the Vicker's hardness of the workpiece by the Vicker's hardness of the punch, x of the die is a hardness ratio obtained by dividing the Vicker's hardness of the workpiece by the Vicker's hardness of the die, and satisfies $0.3 \leq x < 1.0$.

2. The manufacturing method of sheared components according to claim 1, wherein one or both of the first retracting surface and the second retracting surface is a curved surface having a curvature of 0.05 mm to 0.5 mm, or one or both of the first retracting surface and the second retracting surface is a chamfer with a chamfer distance of C0.05 mm to C0.5 mm.

3. The manufacturing method of sheared components according to claim 2, wherein at least one of a first condition in which a frictional resistance of the first retracting surface is the highest among the first tip end surface, the first retracting surface, and the outer surface of the punch, or a second condition in which a frictional resistance of the second retracting surface is the highest among the second tip end surface, the second retracting surface, and the inner surface of the die, is satisfied.

4. The manufacturing method of sheared components according to claim 2, wherein any one of a surface decarbonizing treatment, a plating, and a specific lubricating treatment is performed with respect to the workpiece.

5. The manufacturing method of sheared components according to claim 1, wherein at least one of a first condition in which a frictional resistance of the first retracting surface is the highest among the first tip end surface, the first retracting surface, and the outer surface of the punch, or a second condition in which a frictional resistance of the second retracting surface is the highest among the second tip end surface, the second retracting surface, and the inner surface of the die, is satisfied.

6. The manufacturing method of sheared components according to claim 5, wherein any one of a surface decarbonizing treatment, a plating, and a specific lubricating treatment is performed with respect to the workpiece.

7. The manufacturing method of sheared components according to claim 1, wherein any one of a surface decarbonizing treatment, a plating, and a specific lubricating treatment is performed with respect to the workpiece.

8. A device for manufacturing a plurality of sheared components by performing a shearing a plurality of times with respect to a workpiece of which a Vicker's hardness is equal to or greater than 0.3 times and less than 1.0 times the lower one of the Vicker's hardness of a punch and the Vicker's hardness of a die, the device comprising:

the die which fixes the workpiece; and the punch which punches the workpiece by bringing the workpiece relatively close to the die, wherein the punch includes a first tip end surface which opposes the workpiece, and a first cutting edge having a first retracting surface which retracts from the first tip end surface considering an approaching direction to the die as a standard, and wherein the die includes a second tip end surface which opposes the workpiece, and a second cutting edge having a second retracting surface which retracts from the second tip end surface considering an approaching direction to the punch as a standard, wherein the first retracting surface in a case of being viewed on a section perpendicular to the first tip end surface, is a curved surface having a curvature that is equal to or greater than Rmin (mm) defined by a following Equation 1 and that is equal to or less than Rmax (mm) defined by a following Equation 2, or a chamfer having an inclination angle of 45° with respect to a tangent of the first tip end surface, and having a width dimension that is equal to or greater than αmin (mm) defined by a following Equation 3 and that is equal to or less than αmax (mm) defined by a following Equation 4, and wherein the second retracting surface in a case of being viewed on a section perpendicular to the second tip end surface, is a curved surface having a curvature that is equal to or greater than Rmin (mm) defined by the following Equation 1 and that is equal to or less than Rmax (mm) defined by the following Equation 2, or a chamfer having an inclination angle of 45° with respect to a tangent of the second tip end surface, and having a width dimension that is equal to or greater than αmin (mm) defined by the following Equation 3 and that is equal to or less than αmax (mm) defined by the following Equation 4

$$R\text{min}=(0.9+0.2e^{-0.08c})(0.3571x^2-0.2595x+0.0965) \quad \text{(Equation 1)}$$

$$R\text{max}=(0.9+0.2e^{-0.08c})(-9.1856x^4+25.17x^3-24.95x^2+11.054x-1.5824) \quad \text{(Equation 2)}$$

$$\alpha\text{min}=0.0222e^{2.0833x}(0.9+0.1e^{-0.07c}) \quad \text{(Equation 3)}$$

$$\alpha\text{max}=(0.9+0.1e^{-0.07c})(-0.3274x^2+0.9768x-0.1457) \quad \text{(Equation 4)}$$

here, e is a base of a natural logarithms, c (mm) indicates a clearance between an inner surface of the die and an outer surface of the punch, and x of the punch is a hardness ratio obtained by dividing the Vicker's hardness of the workpiece by the Vicker's hardness of the punch, x of the die is a hardness ratio obtained by dividing the Vicker's hardness of the workpiece by the Vicker's hardness of the die, and satisfies $0.3 \leq x < 1.0$.

9. The manufacturing device of sheared components according to claim 8, wherein one or both of the first retracting surface and the second retracting surface is a curved surface having a curvature of 0.05 mm to 0.5 mm, or a chamfer distance of C0.05 mm to C0.5 mm.

10. The manufacturing device of sheared components according to claim 9, wherein at least one of a first condition in which a frictional resistance of the first retracting surface is the highest among the first tip end surface, the first retracting surface, and the outer surface of the punch, or a second condition in which a frictional resistance of the second retracting surface is the highest among the second tip end surface, the second retracting surface, and the inner surface of the die, is satisfied.

11. The manufacturing device of sheared components according to claim 8, wherein at least one of a first condition in which a frictional resistance of the first retracting surface is the highest among the first tip end surface, the first retracting surface, and the outer surface of the punch, or a second condition in which a frictional resistance of the second retracting surface is the highest among the second tip end surface, the second retracting surface, and the inner surface of the die, is satisfied.

* * * * *